US009184538B1

(12) United States Patent
McGuire

(10) Patent No.: US 9,184,538 B1
(45) Date of Patent: Nov. 10, 2015

(54) REPLACEMENT ADAPTOR FOR BROKEN CLIP ON CABLE CONNECTOR

(71) Applicant: James F. McGuire, Lakeland, FL (US)

(72) Inventor: James F. McGuire, Lakeland, FL (US)

( * ) Notice: Subject to any disclaimer, the term of this patent is extended or adjusted under 35 U.S.C. 154(b) by 32 days.

(21) Appl. No.: 14/160,848

(22) Filed: Jan. 22, 2014

Related U.S. Application Data

(60) Provisional application No. 61/755,550, filed on Jan. 23, 2013.

(51) Int. Cl.
*H01R 13/625* (2006.01)
*H01R 13/627* (2006.01)

(52) U.S. Cl.
CPC ..... *H01R 13/627* (2013.01)

(58) Field of Classification Search
CPC .... H01R 31/06; H01R 31/02; H01R 2201/06; H01R 27/02; H01R 29/00; H01R 13/6275; H01R 13/639; H01R 13/6395; H01R 13/62; H01R 13/627; H01R 23/025
USPC ..... 439/345, 502, 133, 638, 352
See application file for complete search history.

(56) References Cited

U.S. PATENT DOCUMENTS 4,469,386 A * 9/1984 Ackerman ..... 439/133
4,647,726 A * 3/1987 Blum ..... 379/435
5,472,352 A * 12/1995 Nishide et al. ..... 439/274
5,556,295 A 9/1996 McFadden et al.
5,666,408 A 9/1997 Lao
5,720,628 A * 2/1998 Usui et al. ..... 439/502
6,213,815 B1 * 4/2001 Wu ..... 439/638
6,485,316 B1 * 11/2002 Chen ..... 439/135
7,025,636 B2 4/2006 Allen
7,121,877 B2 * 10/2006 Lin ..... 439/502
7,128,600 B2 * 10/2006 Osypka ..... 439/502
7,361,047 B2 4/2008 Strahl
7,371,086 B2 5/2008 Yamada et al.
7,494,351 B2 2/2009 Chiang et al.
7,540,756 B1 6/2009 Strahl
7,708,581 B2 5/2010 Weiss
7,731,519 B1 * 6/2010 Swenson, Jr. ..... 439/352
7,887,358 B2 * 2/2011 Dean ..... 439/345

* cited by examiner

*Primary Examiner* — Abdullah Riyami
*Assistant Examiner* — Vladimir Imas
(74) *Attorney, Agent, or Firm* — Frijouf, Rust & Pyle, P.A.

(57) ABSTRACT

An improved electrical conduit is disclosed for conveying an electrical current between a male plug and a female receptacle. The electrical conduit comprises a substitute male plug for engaging with the female receptacle. A substitute locking clip is pivotably mounted to the substitute male plug engaging with the locking clip receiver for preventing inadvertent removal of the substitute male plug from the female receptacle. A substitute female clip engages with the male plug. A flexible electrical conduit couples the substitute male plug and the substitute female clip for transmitting the electrical current between the male plug and the female receptacle.

15 Claims, 28 Drawing Sheets

REPLACEMENT ADAPTOR FOR BROKEN CLIP ON CABLE CONNECTOR

FIELD OF THE INVENTION

This invention relates to adaptors and more particularly to the replacement adaptor for a broken clip on cable connector.

BACKGROUND OF THE INVENTION

In 1975, a patent was issued for an electrical connecting device for terminating cords and methods of assembling the devices to cords. The connecting devices described in the aforesaid patent replaced many hard-wired connections. Although originally developed for the telephone industry, these devices have become commonplace in a wide variety of electronic devices. These modular connectors provided the ability to rapidly connect as well as disconnect devices from cords with ease.

Modular connectors are designed to be latched together. A spring loaded clip on the plug end interacts with the socket to latch the connector. Removal of the plug is achieved by depressing the latch clip to remove the plug from the socket. The design of the modular connector, however, suffers from a major design deficiency. The latch clip is easily snagged and breaks off the connector. The connector remains electrically functional, however the plug is no longer latched to the socket and may disconnect by the slightest movement of the cable, or vibration of the connector. The most commonplace solution to this problem has been to replace the cord containing the defective plug. Alternately, the more complex and time consuming solution was the replacement of the plug on the cord.

There have been many in the prior art who have attempted to solve these problems with varying degrees of success. None, however completely satisfies the requirements for a complete solution to the aforestated problem. The following U.S. patents are attempts of the prior art to solve this problem.

U.S. Pat. No. 5,556,295 to McFadden, et al. discloses a modular plug locked in a modular receptacle by a frangible locking member disintegral from such modular plug. An internal first catch on that frangible locking member catches an inside of the modular receptacle. The internal first catch is rendered inaccessible from outside the modular receptacle when the frangible locking member and the modular plug are in place in that modular receptacle. A second catch on the frangible locking member detains the modular plug in the modular receptacle until the frangible locking member has been broken up. A device for locking a modular plug in a modular receptacle has a locking member disintegral from such modular plug and having a frangible head. A pair of spaced flexible prongs project from such head. A catch on each of such flexible prongs is spaced from the frangible head and a third or middle prong projects from the head between the pair of spaced flexible prongs.

U.S. Pat. No. 5,666,408 to Lao discloses a 4-pin telephone jack adapter which alters the pin configuration of a 4-pin telephone jack such that the phone line connected to the two outer pins of the jack is connected to the two inner pins of the adapter and be accessible to a one-line telephone set. The 4-pin telephone jack adapter can have two receptacle one of which alters the pin configuration of a 4-pin telephone jack while the other has the same pin configuration. With such an adapter, two one-line telephone sets can separately access to two phone lines connected to a 4-pin telephone jack. The same pin connection can be applied to a telephone cable coupler and a telephone extension cable.

U.S. Pat. No. 7,025,636 to Allen discloses an electrical adapter for receiving a male plug having male plug electrical contacts and having a broken latching tab. The male plug is constructed to be received in a receiving unit in a plugging fashion. The adapter also comprises a female end for electrically receiving the male plug and a male end for electrically connecting the adapter to the receiving unit in a plugging fashion.

U.S. Pat. No. 7,361,047 to Strahl discloses a replacement depressible tab for use on a RJ45 Ethernet connector or other such modular connector when the original depressible tab has broken off. The replacement tab of the present invention is incorporated into a housing having a top wall, two side walls, a partial bottom wall and generally open back. The side walls are cut away in a step-back fashion until they merge with the top wall. At the point of the merger, the top wall forms a tongue to which is attached the replacement depressible tab.

U.S. Pat. No. 7,371,086 to Yamada, et al. discloses an anti-unplugging unit attached to a plug of a transmission cord and to be put in a jack of electronic or communications equipment with the plug for preventing unauthorized removal of the plug from the jack. The anti-unplugging unit includes a latch member having an engaging portion for engaging a predetermined portion of a jack when the unit with the plug is inserted into the jack, lock means for selectively allowing or preventing release of engagement of the engaging portion with the predetermined portion of the jack, and a housing fixable to the plug and accommodating the latch member and the lock means. The invention also provides a transmission cord including a first cord having plugs at both ends, and the anti-unplugging unit fixed to at least one of the plugs.

U.S. Pat. No. 7,494,351 to Chiang, et al. discloses a connector for coupling a computer peripheral device with a RJ11 or R45 data communication socket of a computer. The connector includes a first connecting part and a second connecting part. The first connecting part has a shape mating with said data communication socket. The second connecting part includes a magnetic element such that the connector is attachable onto said computer peripheral device. The peripheral may be a mouse provided with a magnetic plate to cooperate with the whereby the mouse, when not in use, may be removably retained to the computer U.S. Pat. No. 7,540,756 to Strahl discloses a replacement depressible tab for use on a modular connector when the original depressible tab has broken off. The replacement tab of the present invention is incorporated into a clip having a top wall, two side walls, bottom-wall flanges forming a partial bottom wall and an open back. The top wall of the clip is formed in the shape of a "T" having a middle tongue section that extends the entire length of the clip and two wing sections. The tongue is sized and configured to fit into the female modular port. The wings are sized and configured to fit over the telecommunications connector with the broken-off tab.

U.S. Pat. No. 7,708,581 to Weiss discloses a replacement clip and method for repairing a modular cable connector having a broken locking clip. The replacement clip comprises a substantially u-shaped housing being configured to mount onto a modular connector having a broken clip, the housing having a top surface and a bottom surface opposite from the top surface, the top surface having an arm extension ending in a locking tab, the locking tab being spaced by the arm extension and located at an end opposite from the cable that the connector is connected to, the bottom surface having a slit therein running parallel to the cable, the slit being configured to mount the replacement clip onto the connector, such that, the locking tab securely holds the connector within a socket and such that mechanical and electrical connections between the connector and the socket are maintained.

Although the aforementioned prior art have contributed to the development of the art of securing a modular connector, none of these prior art patents have solved the needs of this art.

Therefore, it is an object of the present invention to provide an improved apparatus for solving the problem of a broken latch on a modular connector.

Another object of this invention is to provide an improved apparatus for rapid cost effective repair of a damaged latch on a modular connector.

Another object of this invention is to provide an improved apparatus that is simple for the operator to use.

Another object of this invention is to provide an improved apparatus that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved * electrical conduit for conveying an electrical current between a male plug and a female receptacle. A locking clip is pivotably mounted on the male plug. The male plug has a front edge, a rear edge, a first side surface, a second side surface, a top surface and a bottom surface for defining a plug width, a plug height and a plug length. The female receptacle has a locking clip receiver for engaging the locking clip during engagement between the male plug and the female receptacle for preventing the inadvertent removal of the male plug from the female receptacle. The electrical conduit comprises a substitute male plug for engaging with the female receptacle. A substitute locking clip is pivotably mounted to the substitute male plug engaging with the locking clip receiver for preventing inadvertent removal of the substitute male plug from the female receptacle. A substitute female clip engages with the male plug. The substitute female clip has a primary wall and a secondary wall each having an interior surface and an exterior surface. The primary wall extends between a proximal end and a distal end. The secondary wall extends between a proximal end and a distal end. The primary wall and the secondary wall define a wall separation distance there between. The wall separation distance is generally equivalent to the plug width. A first plug hook is coupled to the interior surface of the primary wall. A second plug hook is coupled to the interior surface of the secondary wall. The primary wall and the secondary wall deflect outwardly upon the first plug hook and the second plug hook contacting the first side surface and the second side surface of the male plug respectively and the primary wall and the secondary wall deflect inwardly upon the first plug hook and the second plug hook being displaced beyond the rear edge of the male plug. The first plug hook engagement with the rear edge of the male plug defines a first retaining lock for preventing inadvertent removal of the male plug from the substitute female clip. The second plug hook engagement with the rear edge of the male plug defines a second retaining lock for preventing inadvertent removal of the male plug from the substitute female clip. A flexible electrical conduit couples the substitute male plug and the substitute female clip for transmitting the electrical current between the male plug and the female receptacle.

In one embodiment of the invention, the substitute female clip has a primary wall, a secondary wall, an upper wall and a lower wall each having an interior surface and an exterior surface. The primary wall extends between a proximal end and a distal end. The secondary wall extends between a proximal end and a distal end. The upper wall extends between a proximal end and a distal end. The lower wall extends between a proximal end and a distal end. The primary wall and the secondary wall define a first wall separation distance there between. The upper wall and the lower wall define a second wall separation distance there between. The first wall separation distance is generally equivalent to the plug width. The second wall separation distance is generally equivalent to the plug height. The primary wall, the secondary wall, the upper wall and the lower wall define an elongated enclosure having an enclosure chamber. The elongated enclosure has an enclosure aperture adjacent to the distal end of the primary wall, the secondary wall, the upper wall and the lower wall for positioning the male plug within the enclosure chamber. The elongated enclosure defines an enclosure length. The enclosure length is greater than the plug length for encapsulating the male plug within the elongated enclosure.

In another embodiment of the invention, the substitute female clip has a cylindrical body defining an exterior cylindrical wall, an interior cylindrical wall and a cylindrical chamber. The cylindrical body extends between a proximal end and a distal end. The distal end of the cylindrical body defines an aperture. The cylindrical body defines a cylindrical diameter. The cylindrical diameter is greater than the plug width for inserting the male plug through the aperture and positioning the male plug within the cylindrical chamber.

In another embodiment of the invention, the distal end of the upper wall has an upper track in the interior surface of the upper wall. The distal end of the lower wall has a lower track in the interior surface of the lower wall. A first closure door has an upper edge, a lower edge, an interior edge, an outer edge, an interior surface and an exterior surface. The interior edge of the first closure door has a first notch. A second closure door has an upper edge, a lower edge, an interior edge, an outer edge an interior surface and an exterior surface. The interior edge of the second closure door has a second notch. The upper edge and the lower edge of the first closure door engage within the upper track and the lower track respectively. The upper edge and the lower edge of the second closure door engage within the upper track and the lower track respectively. The interior edge of the first closure door and the interior edge of the second closure door abut for preventing inadvertent removal of the male plug from the substitute female clip and for defining a door notch from the first notch and the second notch for receiving the flexible electrical conduit.

In another embodiment of the invention, the elongated enclosure includes a first hook channel, a second hook channel, a third hook channel and a fourth hook channel. A closure wall has a first closure arm, a second closure arm, a third closure arm and a fourth closure arm. The first closure arm, the second closure arm, the third closure arm and the fourth closure arm include a first arm hook, a second arm hook, a third arm hook and a fourth arm hook respectively. The first arm hook, the second arm hook, the third arm hook and the fourth arm hook contact the elongated enclosure and the first closure arm, the second closure arm, the third closure arm and the fourth closure arm deflect outwardly upon the closure wall positioned over the enclosure aperture. The first arm hook, the second arm hook, the third arm hook and the fourth arm hook engage with the first hook channel, the second hook channel, the third hook channel and the fourth hook channel, respectively and the first closure arm, the second closure arm, the third closure arm and the fourth closure arm deflect inwardly for defining a first closure lock, a second closure lock, a third closure lock and a fourth closure lock respectively for maintaining the closure wall against the enclosure aperture. The closure wall abutting the enclosure aperture defines a closed position for preventing inadvertent removal of the male plug from the substitute female clip. The closure wall has a closure wall slot for receiving the flexible electrical conduit upon closure wall positioned into the closed position.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
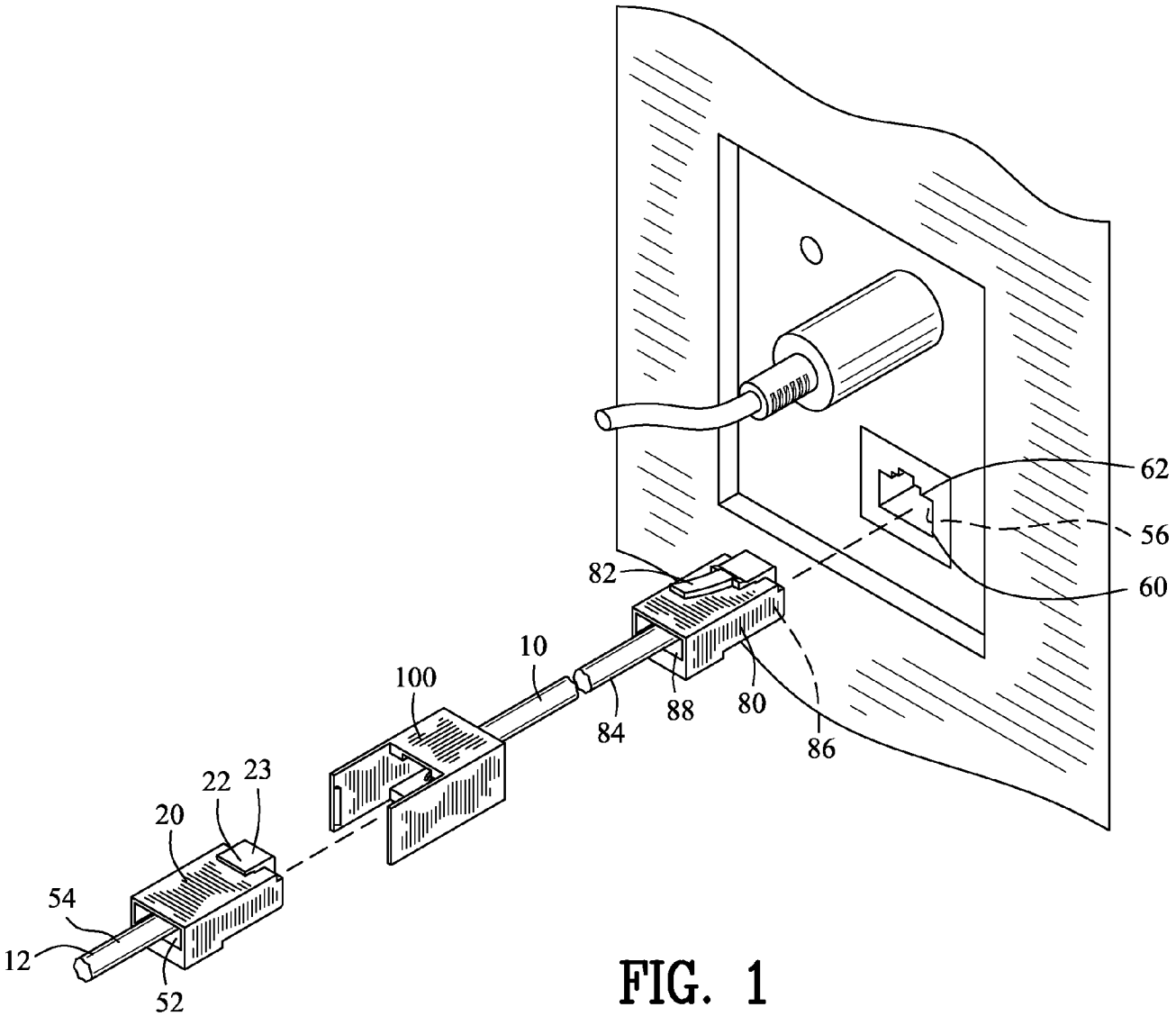
FIG. 1 is a front isometric view of an electrical conduit for conveying an electrical current between a male plug and a female receptacle incorporating a first embodiment of the present invention.
Figure 2:
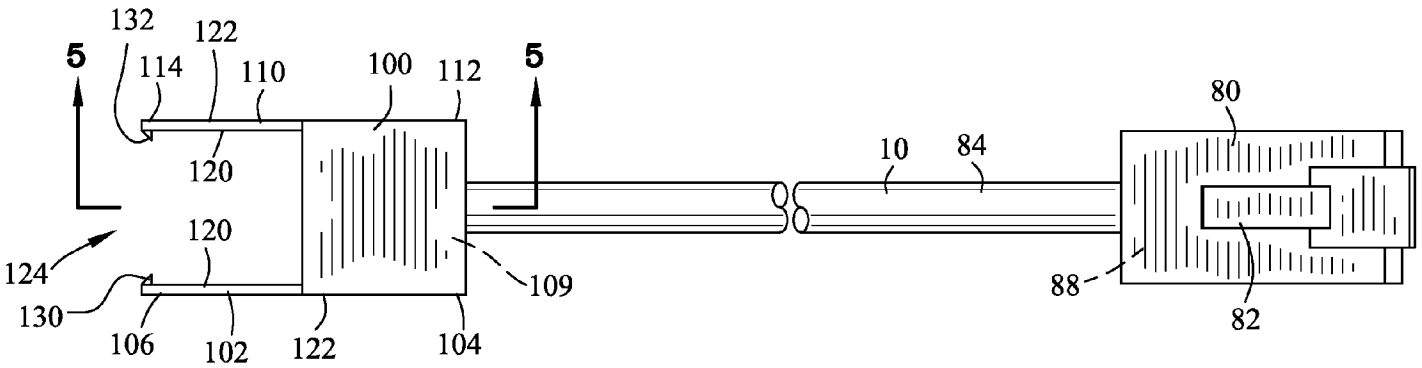
FIG. 2 is a top view of the electrical conduit of FIG. 1.
Figure 3:
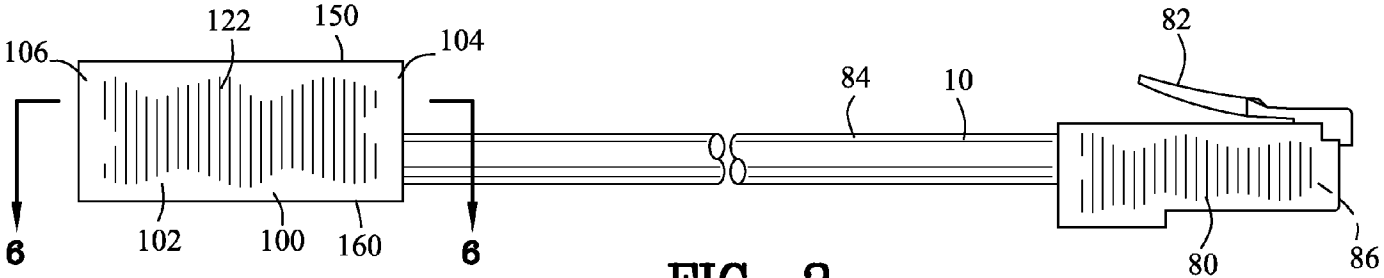
FIG. 3 is a side view of FIG. 2.
Figure 4:
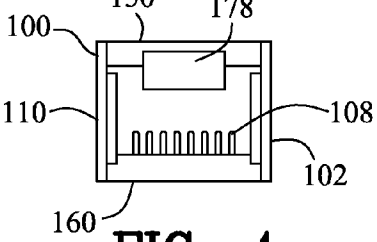
FIG. 4 is a rear view of FIG. 2.
Figure 5:
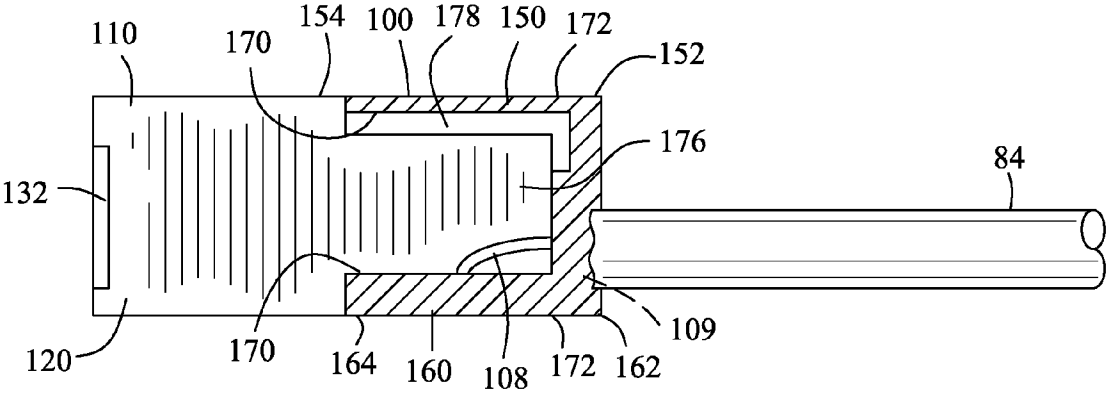
FIG. 5 is a sectional view along line 5-5 in FIG. 2.
Figure 6:
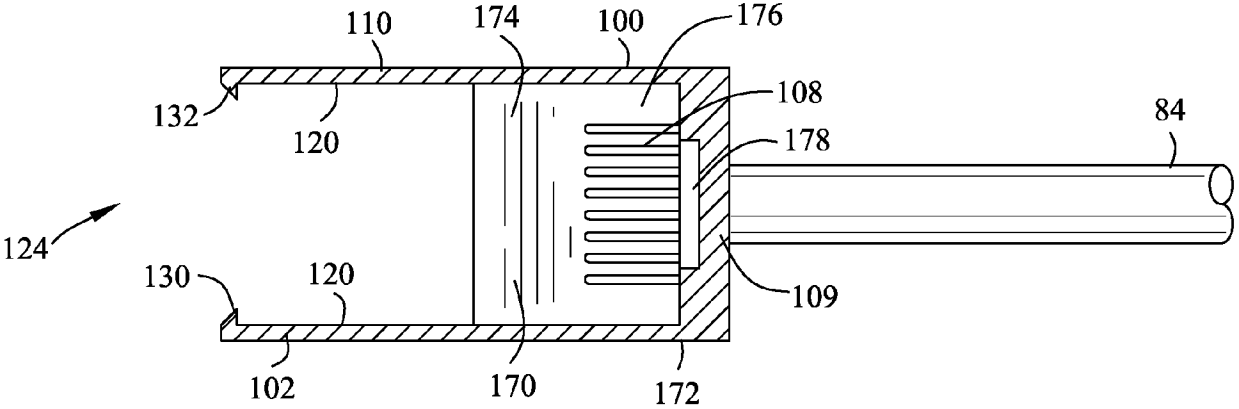
FIG. 6 is a sectional view along line 6-6 in FIG. 3.
Figure 7:
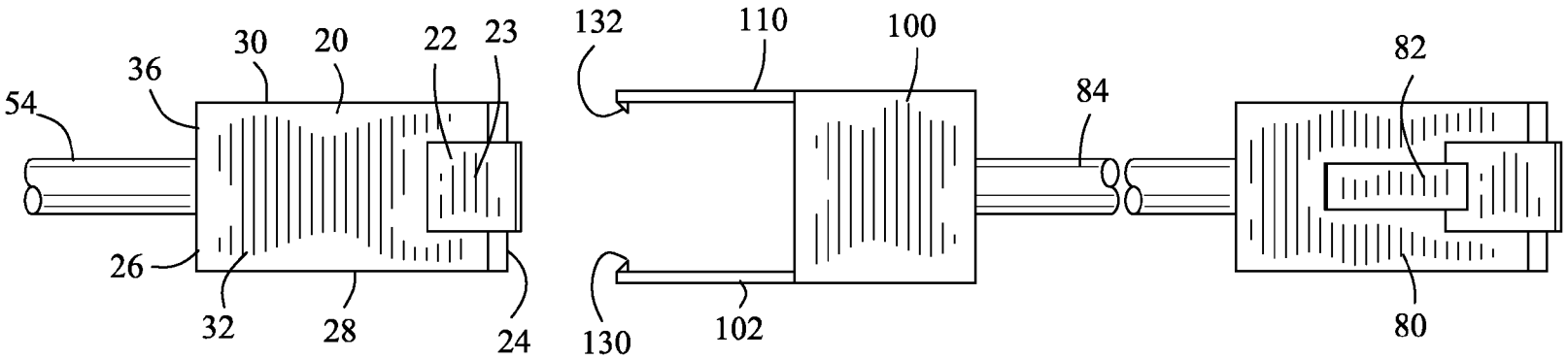
FIG. 7 is a view similar to FIG. 2 illustrating the male plug positioned adjacent to the substitute female clip.
Figure 8:
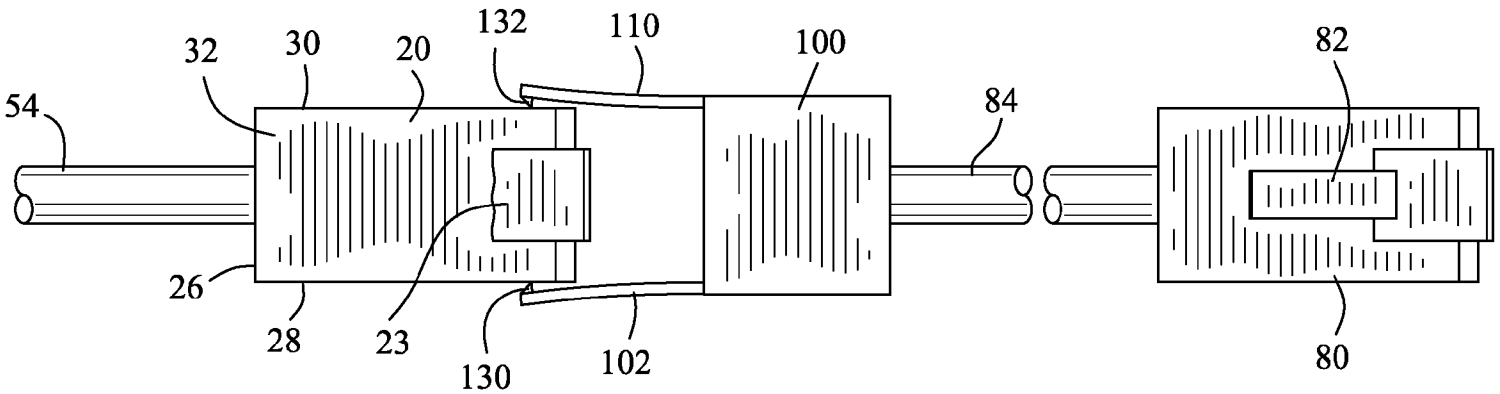
FIG. 8 is a view similar to FIG. 7 illustrating a primary wall and a secondary wall of the substitute female clip deflecting outwardly upon a first plug hook and a second plug hook contacting a first side surface and a second side surface of the male plug, respectively.
Figure 9:
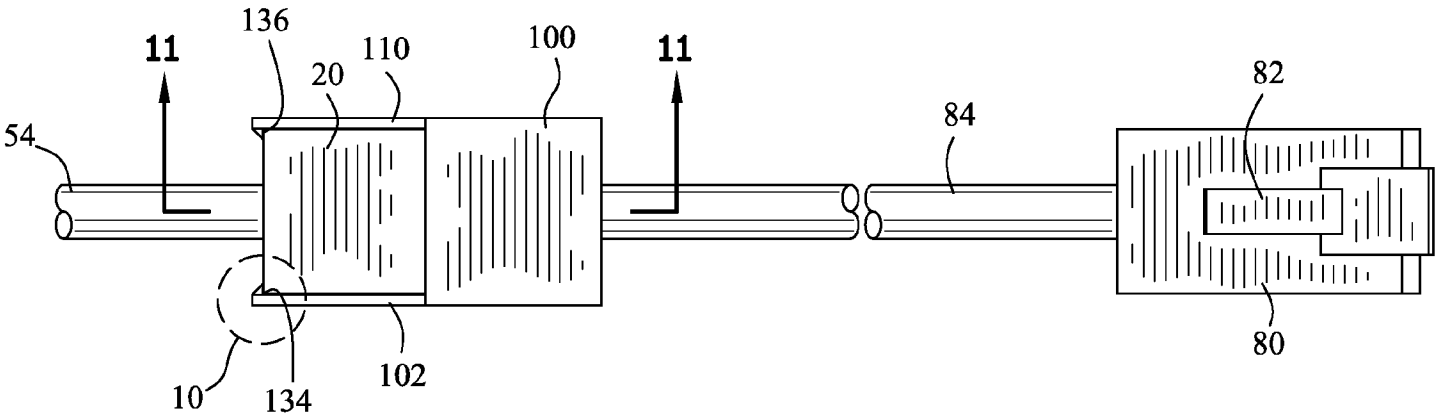
FIG. 9 is a view similar to FIG. 8 illustrating the primary wall and the secondary wall deflected inwardly upon the first plug hook and the second plug hook being displaced beyond the male plug for defining a first retaining lock and a second retaining lock for preventing inadvertent removal of the male plug from the substitute female clip.
Figure 11:
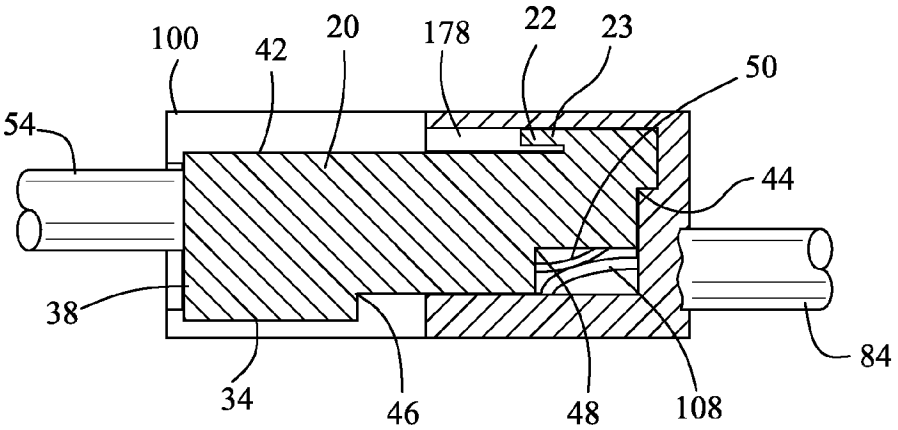
FIG. 11 is a sectional view along line 11-11 in FIG. 9.
Figure 10:
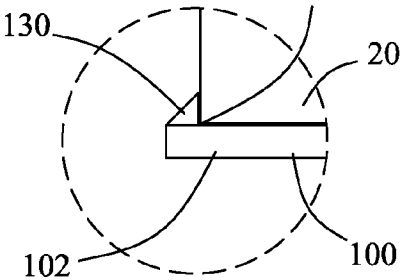
FIG. 10 is an enlarge portion of FIG. 9 illustrating the second plug hook being displaced beyond the male plug for defining the second retaining lock for preventing inadvertent removal of the male plug from the substitute female clip.
Figure 12:
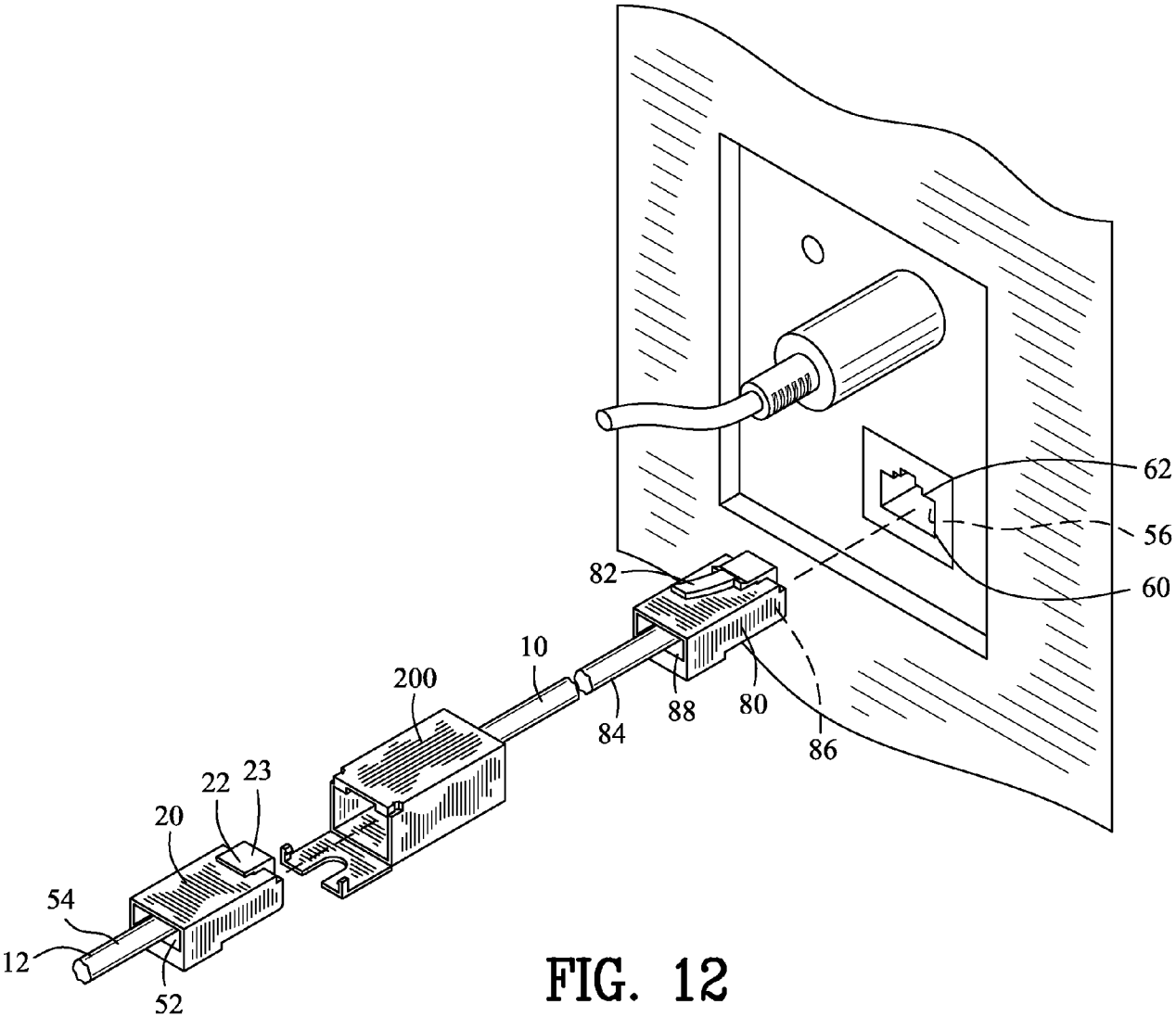
FIG. 12 is a front isometric view of an electrical conduit for conveying an electrical current between a male plug and a female receptacle incorporating a second embodiment of the present invention.
Figure 13:
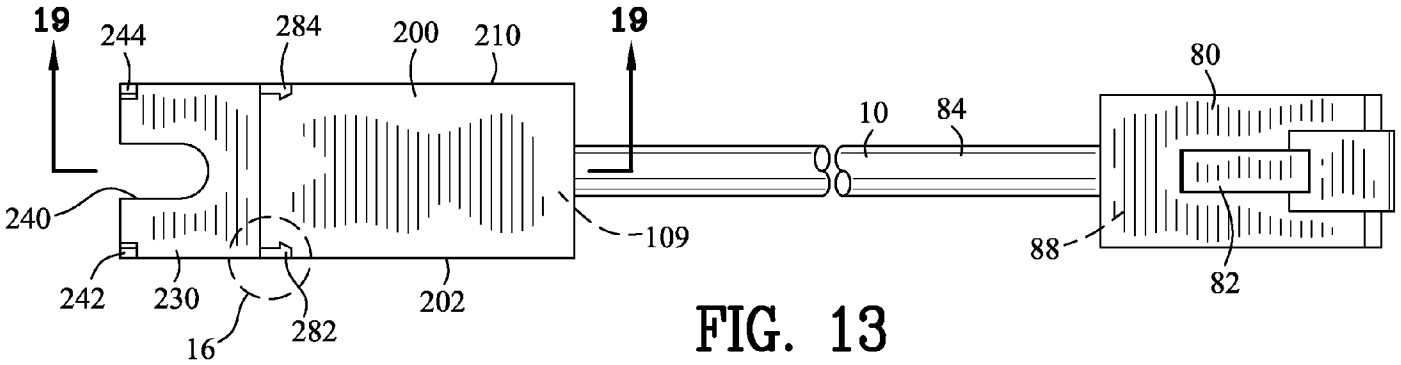
FIG. 13 is a top view of the electrical conduit of FIG. 12.
Figure 14:
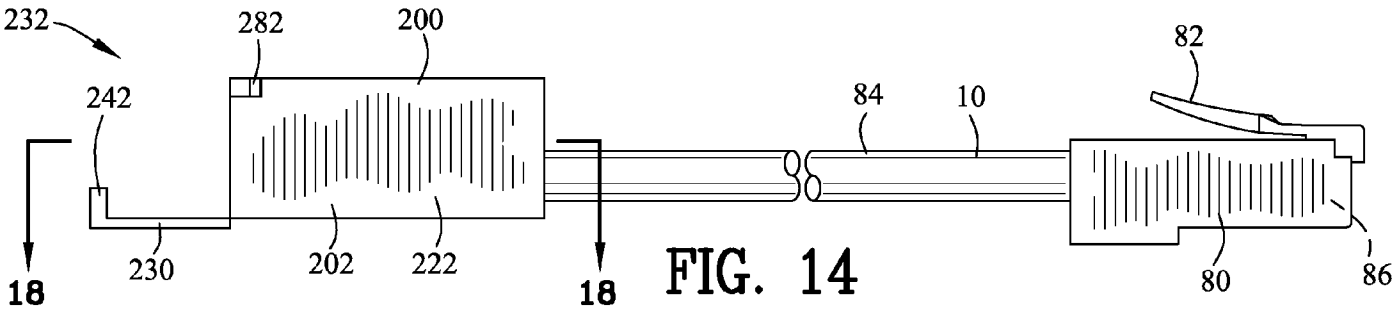
FIG. 14 is a side view of FIG. 13.
Figure 15:
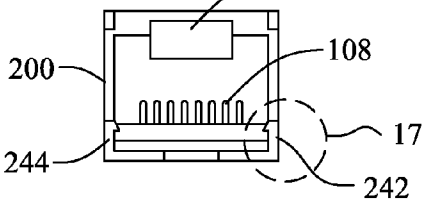
FIG. 15 is a rear view of FIG. 13.
Figure 16:
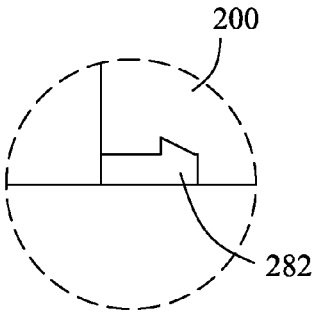
FIG. 16 is an enlarged portion of FIG. 13 illustrating an elongated enclosure having a hook channel.
Figure 17:
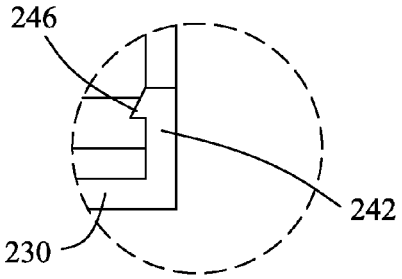
FIG. 17 is an enlarge portion of FIG. 15 illustrating a closure arm having an arm hook.
Figure 18:
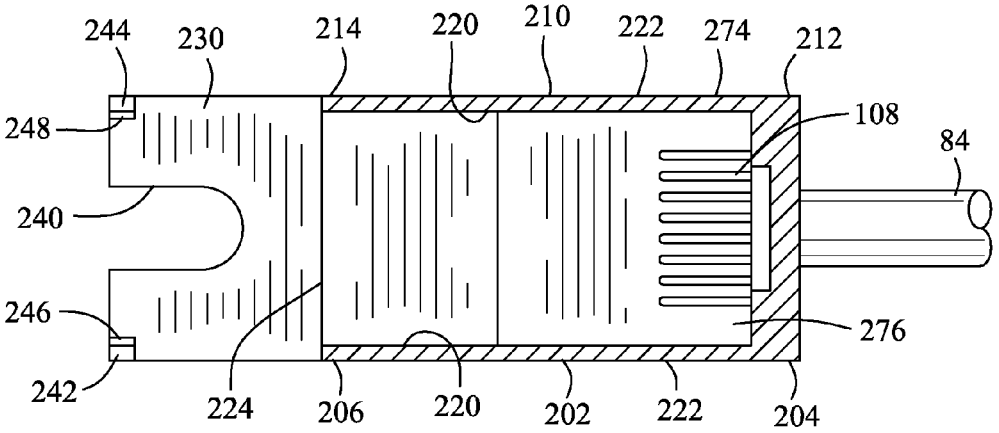
FIG. 18 is a sectional view along line 18-18 in FIG. 14.
Figure 19:
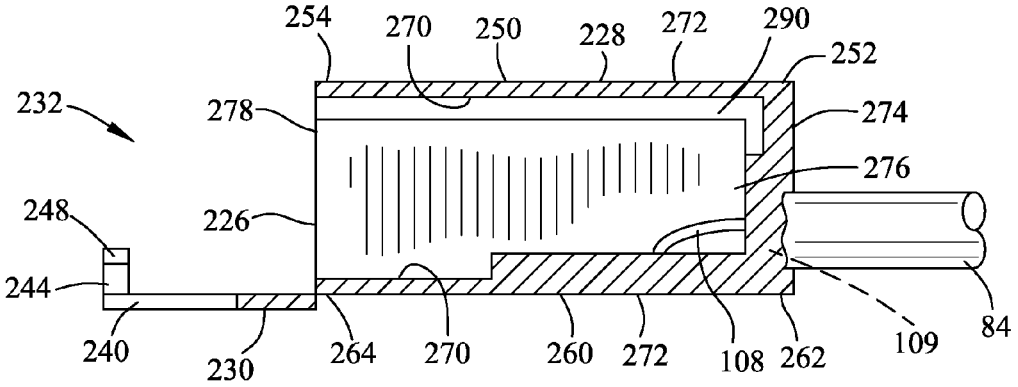
FIG. 19 is a sectional view along line 19-19 in FIG. 13.
Figure 20:
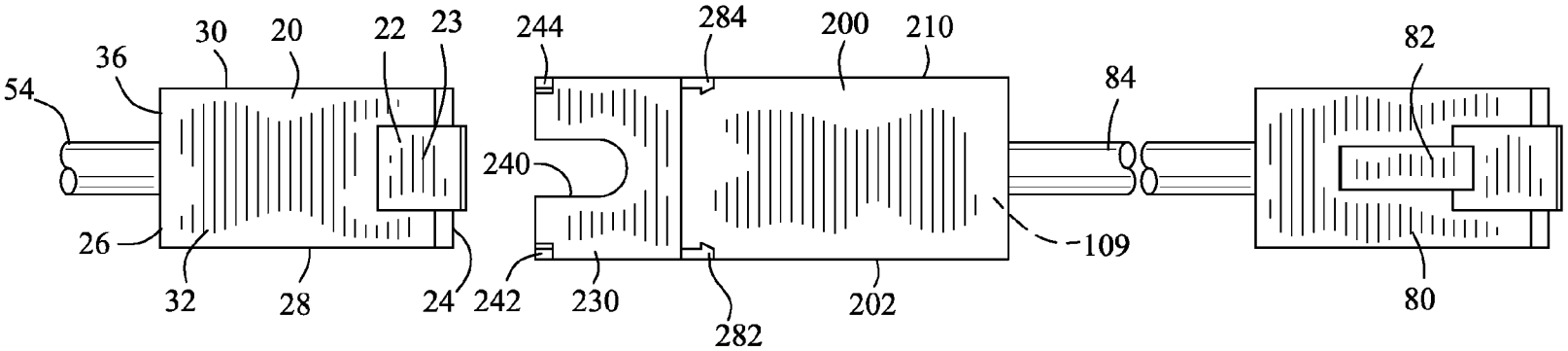
FIG. 20 is a view similar to FIG. 13 illustrating the male plug positioned adjacent to the substitute female clip.
Figure 21:
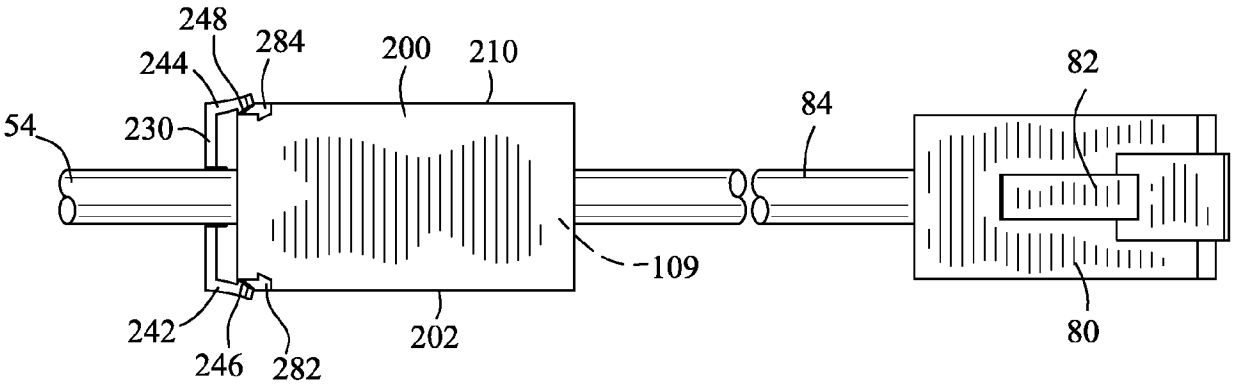
FIG. 21 is a view similar to FIG. 20 illustrating a first closure arm and a second closure arm of a closure wall deflecting outwardly upon a first arm hook and a second arm hook contacting a primary wall and a secondary wall of the substitute female clip respectively.
Figure 72:
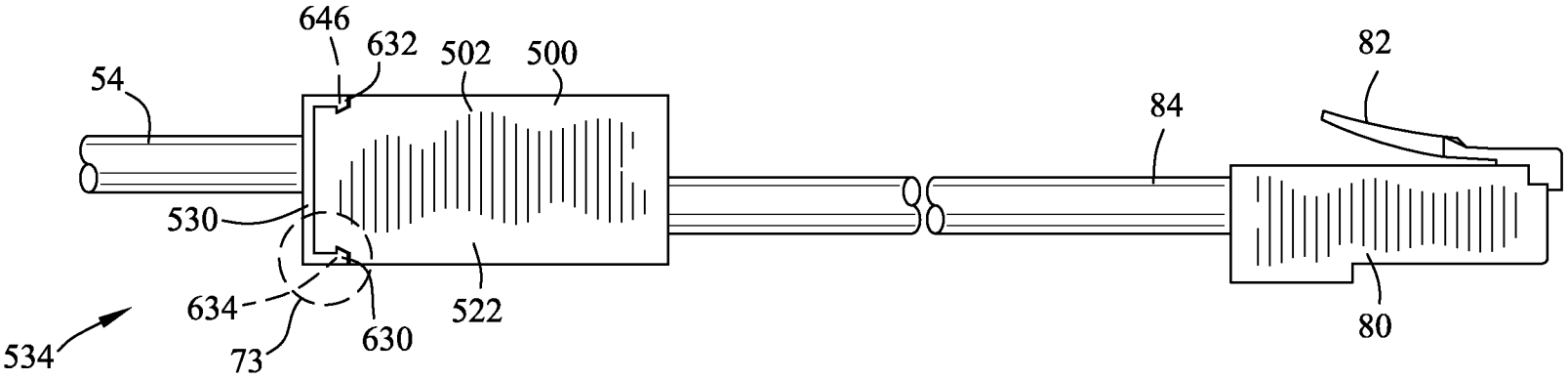
FIG. 72 is a view similar to FIG. 71 illustrating the first closure arm, the second closure arm, the third closure arm and the fourth closure arm deflected inwardly upon the first arm hook, the second arm hook, the third arm hook and the fourth arm hook being positioned within the first hook channel, the second hook channel, the third hook channel and the fourth hook channel for defining a first closure lock, a second closure lock, a third closure lock and a fourth closure lock respectively and for preventing inadvertent removal of the male plug from the substitute female clip.
Figure 73:
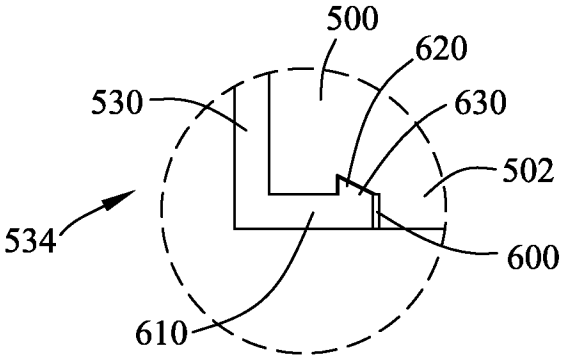
FIG. 73 is an enlarged portion of FIG. 72.

FIGS. 1-72 are various view of an electrical conduit 10 for conveying an electrical current 12 between a male plug 20 and a female receptacle 60 incorporating a first embodiment of the present invention. As shown in FIGS. 1, 12, 25, 39 and 59 illustrate a locking clip 22 is pivotably mounted on the male plug 20. The male plug 20 has a front edge 24, a rear edge 26, a first side surface 28, a second side surface 30, a top surface 32 and a bottom surface 34 for defining a plug width 36, a plug height 38, a plug depth 40 and a plug length 42. A front step 44 is located on the front edge 24 and a bottom step 46 located on the bottom surface 34. A contact channel 48 is extends between the front edge 24 and the bottom surface 34. The contact step 48 houses a plurality of electrical contacts 50. A plug channel 52 traverses the male plug 20 for coupling an electrical cable 54 with the plurality of electrical contacts 50. The electrical cable 54 may include telephone wire, RJ-11 cable, RJ-45 cable or other electrical wires or cables.

The female receptacle 60 has a locking clip receiver 62 for engaging the locking clip 22 during engagement between the male plug 20 and the female receptacle 60 for preventing the inadvertent removal of the male plug 20 from the female receptacle 60. The female receptacle 60 may be positioned within a wall 64, other stationary object or non-stationary object. The female receptacle 60 houses a second plurality of electrical contacts 56 for mating with the first plurality of electrical contacts 50 upon the female receptacle 60 receiving the male plug 20. Upon mating between the second plurality of electrical contacts 56 and the plurality of electrical contacts 50, the electrical current 12 can be displaced between the female receptacle 60 and the male plug 20.

If the locking clip 22 has separated from the male plug 20, it may be possible the male plug 20 would inadvertently be removed of the female receptacle 60. This separation would result in loss of electrical current between the male plug 20 and the female receptacle 60.

Both the electrical cable 54 and the male plug 20 which has a separated locking clip 22 as shown in FIGS. 1, 12, 25, 39 and 59 may continued to be utilized by the implication of electrical conduit 10 of the present invention. FIGS. 1-11 are various view of a first embodiment of the electrical conduit 10. The electrical conduit 10 comprises a substitute male plug 80 for engaging with the female receptacle 60. A substitute locking clip 82 is pivotably mounted to the substitute male plug 80 and may engage with the locking clip receiver 62 for preventing inadvertent removal of the substitute male plug 80 from the female receptacle 60. The substitute male plug 80 preferably is similar in shape to the male plug 20. Similar to the male plug 20, the substitute male plug 80 includes a first substitute plurality of electrical contacts 86.

A substitute female clip 100 engages with the male plug 20. The substitute female clip 100 has a primary wall 102 and a secondary wall 110 each having an interior surface 120 and an exterior surface 122. The primary wall 102 extends between a proximal end 104 and a distal end 106. The secondary wall 110 extends between a proximal end 112 and a distal end 114. The primary wall 102 and the secondary wall 110 define a wall separation distance 124 there between. The wall separation distance 124 is generally equivalent to the plug width 36. Similar to the female receptacle 60, the substitute female clip includes a second substitute plurality of electrical contacts 108.

A first plug hook 130 is coupled to the interior surface 120 of the primary wall 102. A second plug hook 132 is coupled to the interior surface 120 of the secondary wall 110. The primary wall 102 and the secondary wall 110 deflect outwardly upon the first plug hook 130 and the second plug hook 132 contacting the first side surface 28 and the second side surface 30 of the male plug 20 respectively and the primary wall 102 and the secondary wall 110 deflect inwardly upon the first plug hook 130 and the second plug hook 132 being displaced beyond the rear edge 26 of the male plug 20.

The first plug hook 130 engagement with the rear edge 26 of the male plug 20 defines a first retaining lock 134 for preventing inadvertent removal of the male plug 20 from the substitute female clip 100. The second plug hook 132 engagement with the rear edge 26 of the male plug 20 defines a second retaining lock 136 for preventing inadvertent removal of the male plug 20 from the substitute female clip 100. A substitute female clip channel 109 traverses the substitute female clip 100 for receiving a flexible electrical conduit 84. The flexible electrical conduit 84 is mated with the second substitute plurality of electrical contacts 108. A substitute male clip channel 88 traverses the substitute male plug 80 for receiving the flexible electrical conduit 84. The flexible electrical conduit 84 is mated with the first substitute plurality of electrical contacts 108.

Upon engagement between the substitute male plug 80 and the female receptacle 60 and between the male plug 20 with the substitute female clip 100, the electrical current 12 between the male plug 20 and the female receptacle 60 may be transmitted. The flexible electrical conduit 84 may include telephone wire, RJ-11 cable, RJ-45 cable or other electrical wires or cables. The length of the flexible electrical conduit 84 may be within three (3) to six (6) inches if the electrical conduit 10 will be utilized for a repair application. Alternatively, the length of the flexible electrical conduit 84 may be ten (10) to thirty (30) feet if the electrical conduit 10 will be utilized for an extension application.

The substitute female clip 100 may further include an upper wall 150 and a lower wall 160 each having an interior surface 170 and an exterior surface 172. The upper wall 150 extends between a proximal end 152 and a distal end 154. The lower wall 160 extends between a proximal end 162 and a distal end 164. The proximal end 152 of the upper wall 150 abuts with the proximal end 104 of the primary wall 102 and the proximal end 112 of the secondary wall 110. The proximal end 162 of the lower wall 160 abuts with the proximal end 104 of the primary wall 102 and the proximal end 112 of the secondary wall 110. The distal end 154 of the upper wall 150 is positioned between the proximal end 104 of the primary wall 102 and the distal end 106 of the primary wall 102. The distal end 164 of the lower wall 160 is positioned between the proximal end 112 of the secondary wall 110 and the distal end 114 of the secondary wall 110. The primary wall 102, the secondary wall 110, the upper wall 150 and the lower wall 160 define a socket 174. The socket 174 defines a socket chamber 176 for receiving the male plug 20 and preventing rotation of the male plug 20 relative to the substitute female clip 100. The interior surface 170 of the upper wall 150 may include a clip channel 178 for receiving the locking clip 22 or partial locking clip 23 of the male plug 20 and preventing rotation of the male plug 20 relative to the substitute female clip 100.

FIGS. 12-24 illustrate a second embodiment of the electrical conduit 10. In the second embodiment the substitute female clip 200 has a primary wall 202, a secondary wall 210, an upper wall 250 and a lower wall 260 each having an interior surface 220 and an exterior surface 222. The primary wall 202 extends between a proximal end 204 and a distal end 206. The secondary wall 210 extends between a proximal end 212 and a distal end 214. The upper wall 250 extends between a proximal end 252 and a distal end 254. The lower wall 260 extends between a proximal end 262 and a distal end 264. The primary wall 202 and the secondary wall 210 define a first wall separation distance 224 there between. The upper wall 250 and the lower wall 260 define a second wall separation distance 226 there between. The first wall separation distance 224 is generally equivalent to the plug width 36. The second wall separation distance 226 is generally equivalent to the plug height 38. The primary wall 202, the secondary wall 210, the upper wall 250 and the lower wall 260 define an elongated enclosure 274 having an enclosure chamber 276. The elongated enclosure 274 has an enclosure aperture 278 adjacent to the distal ends 206, 214, 254 and 264 of the primary wall 202, the secondary wall 210, the upper wall 250 and the lower wall 260 for positioning the male plug 20 within the enclosure chamber 276. The elongated enclosure 274 defines an enclosure length 228. The enclosure length 228 is greater than the plug length 42 for encapsulating the male plug 20 within the elongated enclosure 274.

Figure 22:
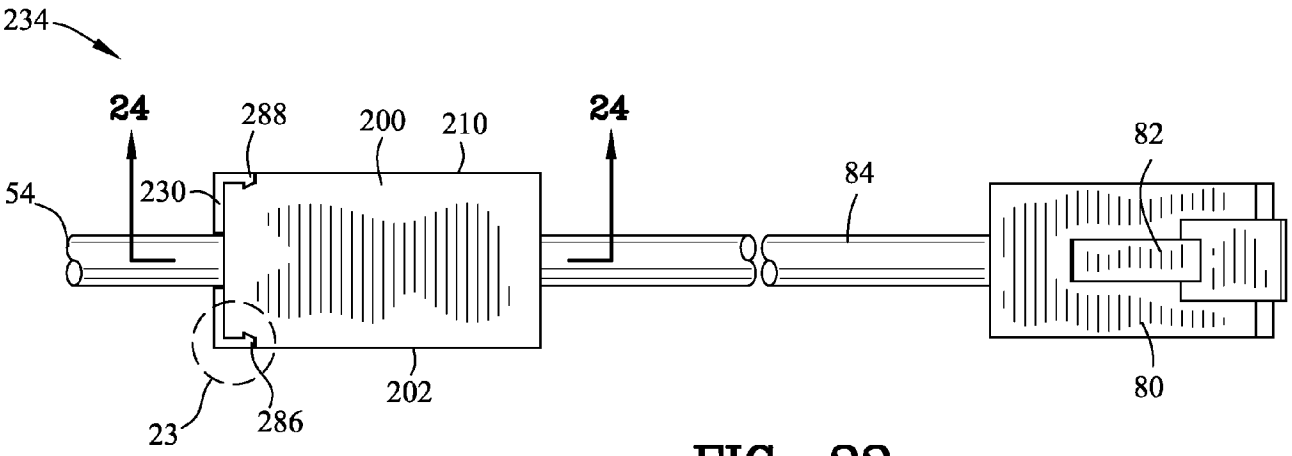
FIG. 22 is a view similar to FIG. 21 illustrating the first closure arm and the second closure arm deflected inwardly upon the first arm hook and the second arm hook being positioned within a first hook channel and a second hook channel for defining a first closure lock and a second closure lock respectively and for preventing inadvertent removal of the male plug from the substitute female clip.
Figure 24:
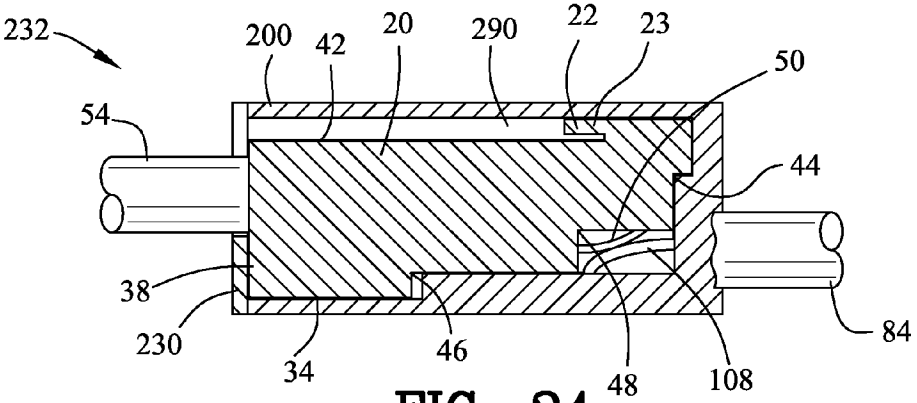
FIG. 24 is a sectional view along line 24-24 in FIG. 22.
Figure 23:
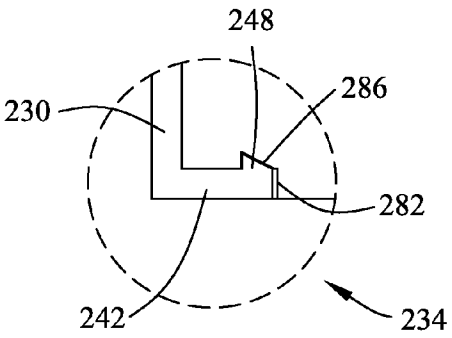
FIG. 23 is an enlarge portion of FIG. 22 illustrating the second arm hook engaging with the second hook channel for defining the second closure lock for preventing inadvertent removal of the male plug from the substitute female clip.
Figure 25:
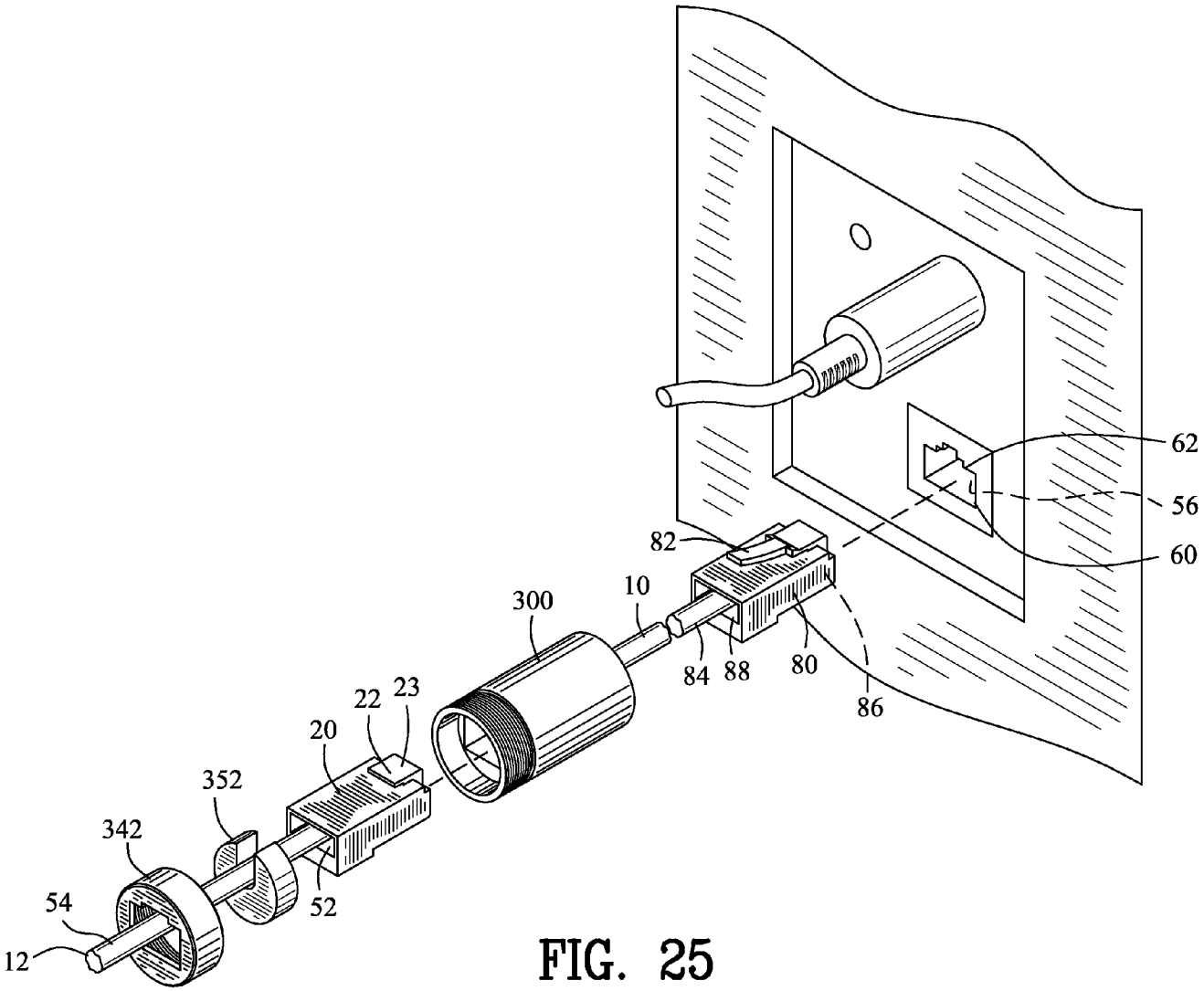
FIG. 25 is a front isometric view of an electrical conduit for conveying an electrical current between a male plug and a female receptacle incorporating a third embodiment of the present invention.
Figure 26:
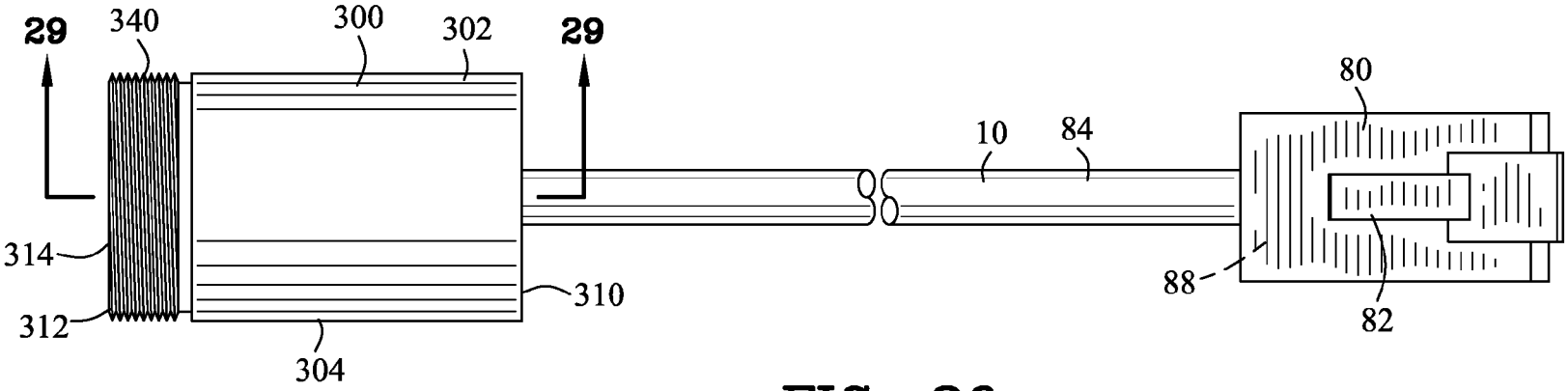
FIG. 26 is a top view of the electrical conduit of FIG. 25.
Figure 27:
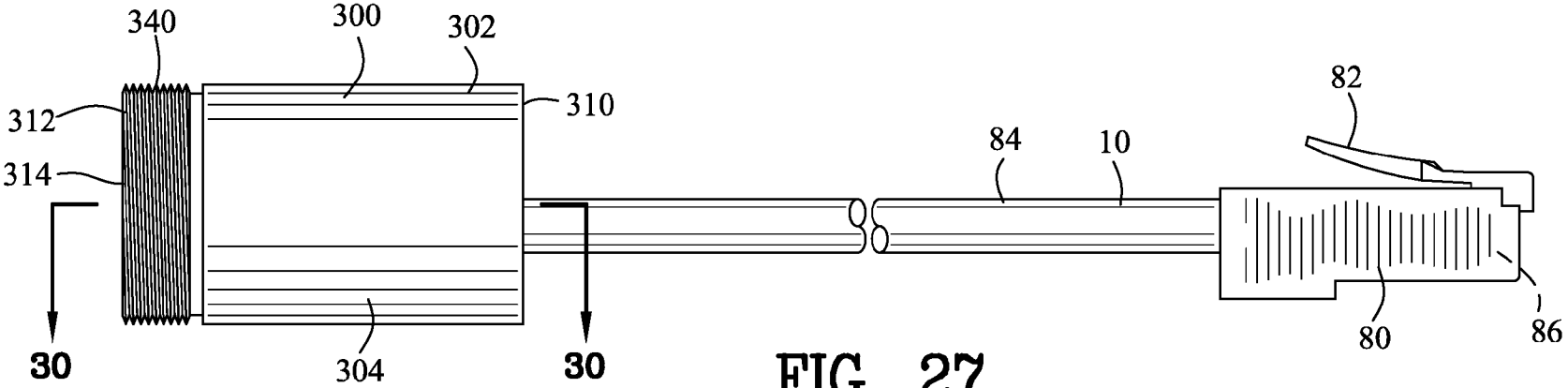
FIG. 27 is a side view of FIG. 26.
Figure 28:
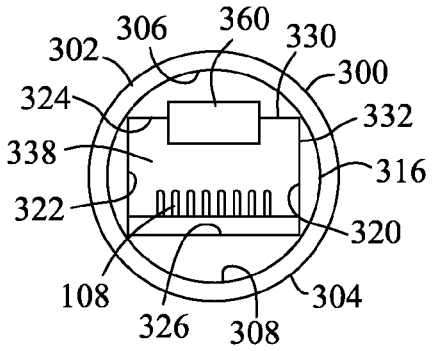
FIG. 28 is a rear view of FIG. 26.
Figure 29:
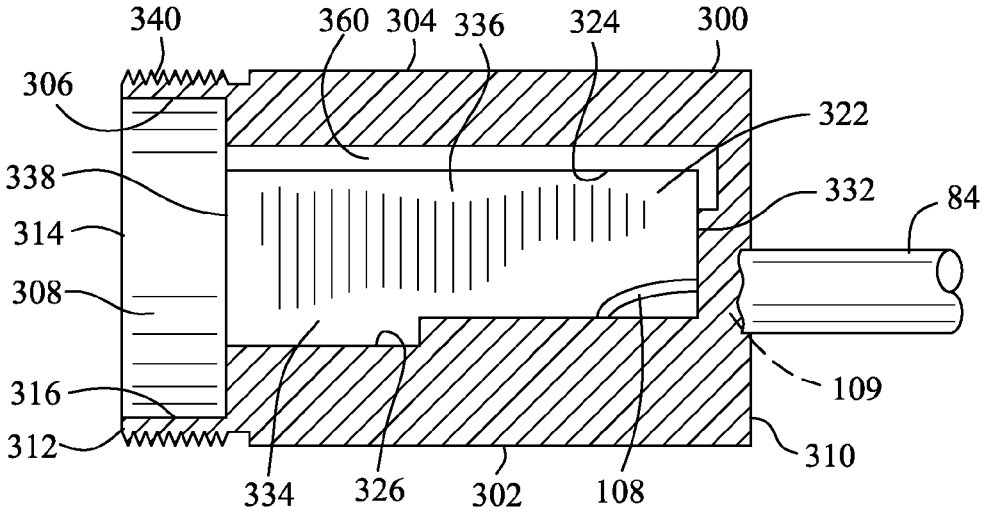
FIG. 29 is a sectional view along line 29-29 in FIG. 26.
Figure 30:
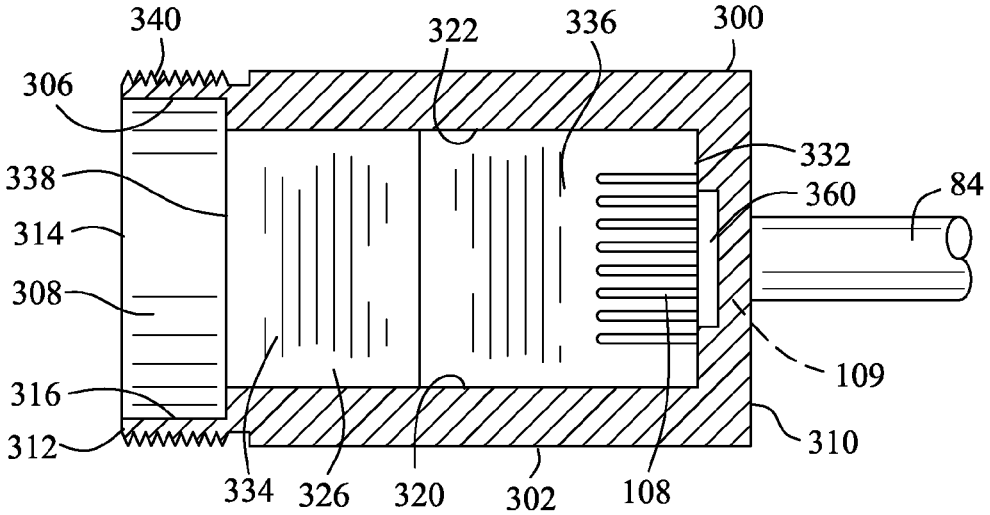
FIG. 30 is a sectional view along line 30-30 in FIG. 27.
Figure 31:
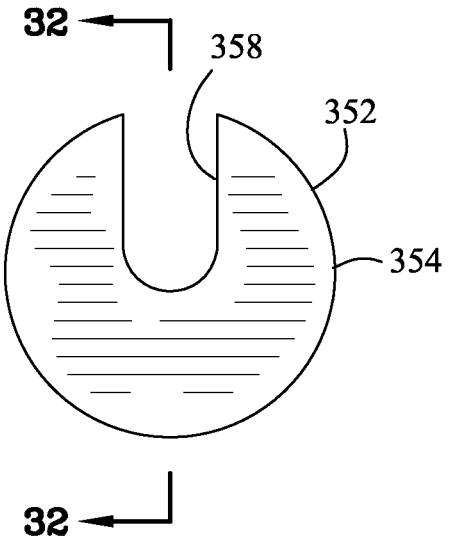
FIG. 31 is a rear view of a cylindrical spacer.
Figure 32:
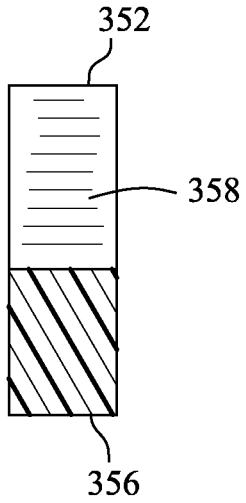
FIG. 32 is a sectional view along line 32-32 in FIG. 31.
Figure 33:
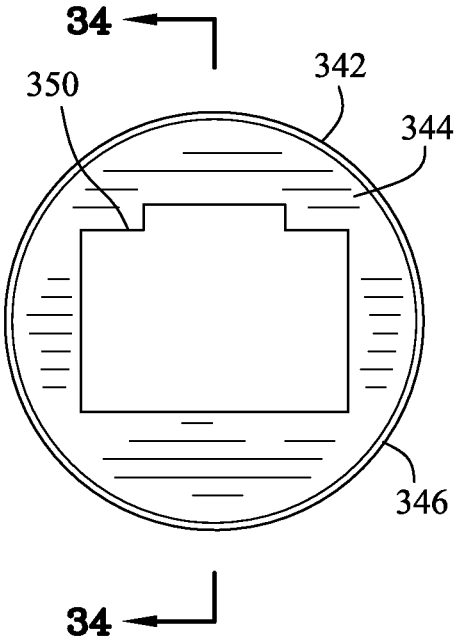
FIG. 33 is a rear view of a cylindrical cap.
Figure 34:
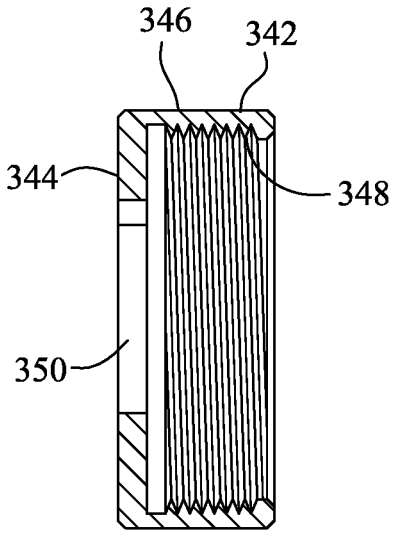
FIG. 34 is a sectional view along line 34-34 in FIG. 33.
Figure 35:
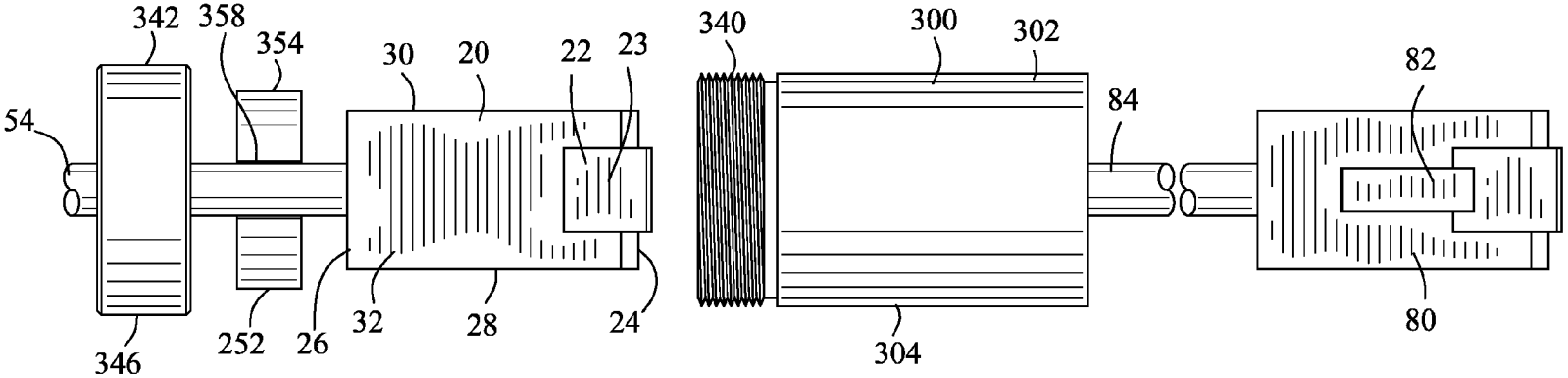
FIG. 35 is a view similar to FIG. 26 illustrating the male plug positioned adjacent to the substitute female clip.
Figure 36:
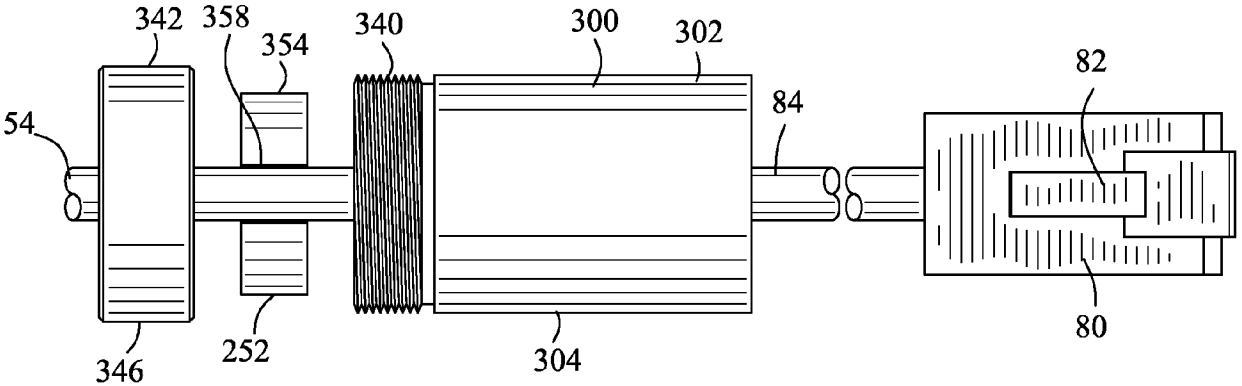
FIG. 36 is a view similar to FIG. 35 illustrating the male plug positioned within a cylindrical body.
Figure 37:
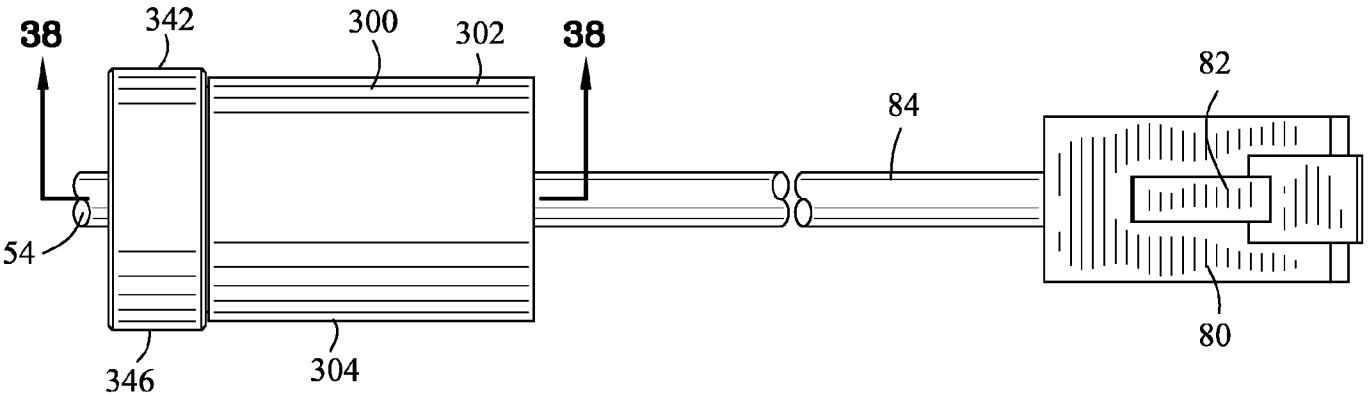
FIG. 37 is a view similar to FIG. 26 illustrating a cylindrical cap threadably engaged with the cylindrical body for compressing the cylindrical spacer against the male plug and preventing inadvertent removal of the male plug from the substitute female clip.
Figure 38:
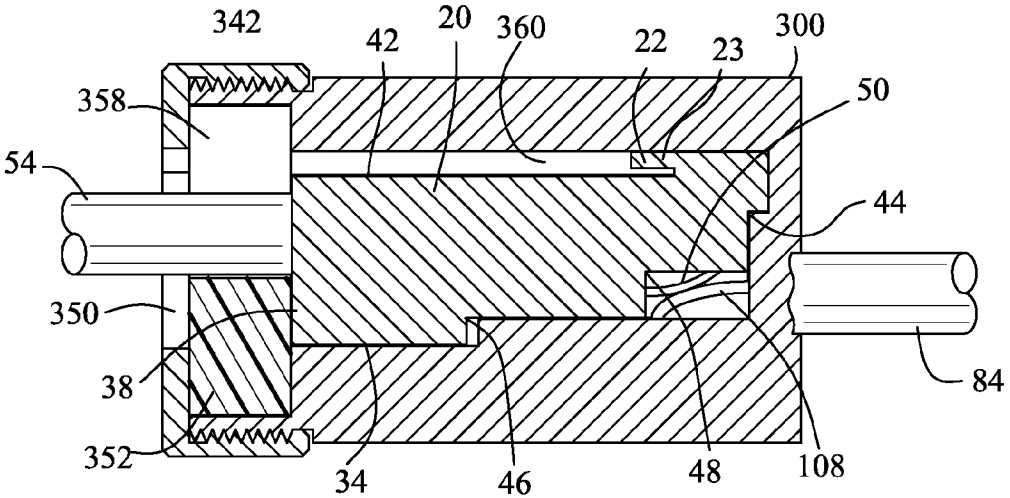
FIG. 38 is a sectional view along line 38-38 in FIG. 37.
Figure 39:
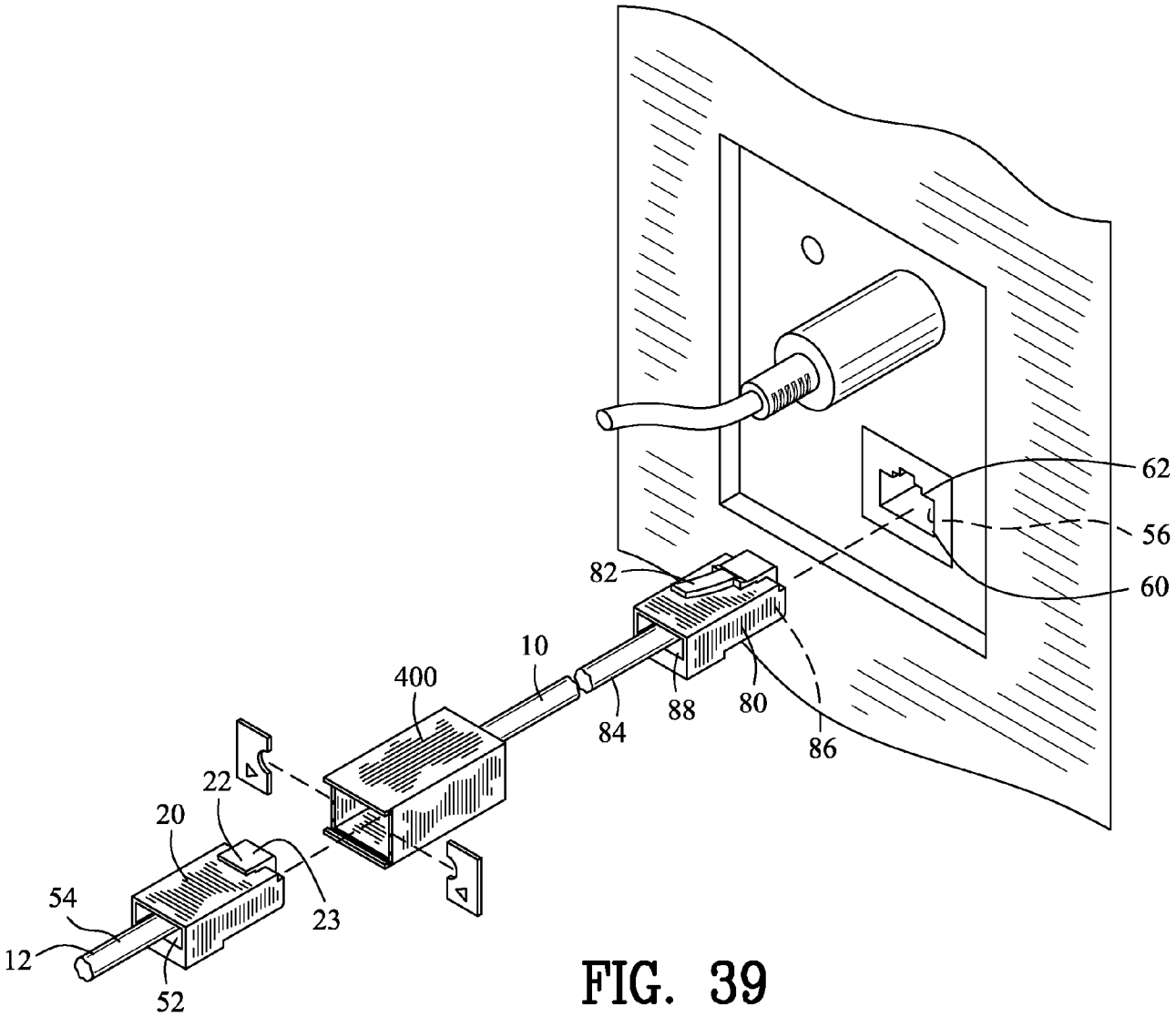
FIG. 39 is a front isometric view of an electrical conduit for conveying an electrical current between a male plug and a female receptacle incorporating a fourth embodiment of the present invention.
Figure 40:
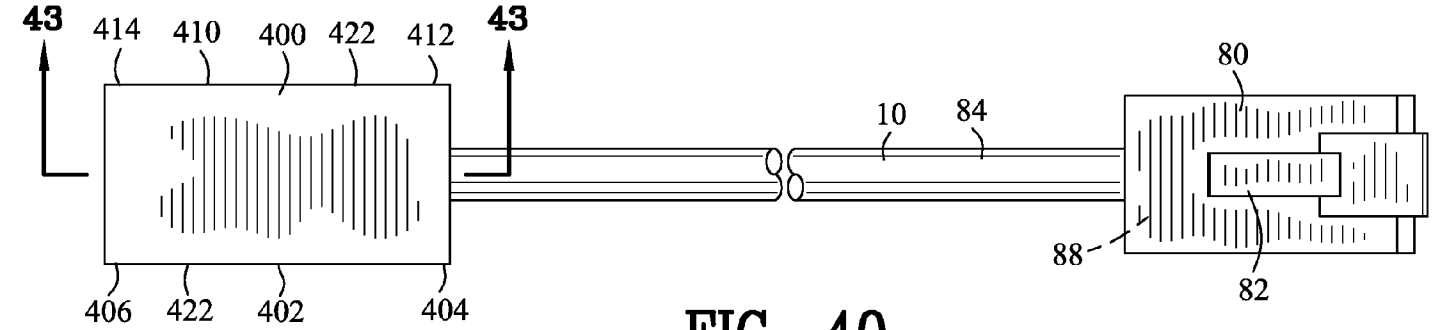
FIG. 40 is a top view of the electrical conduit of FIG. 39.
Figure 41:
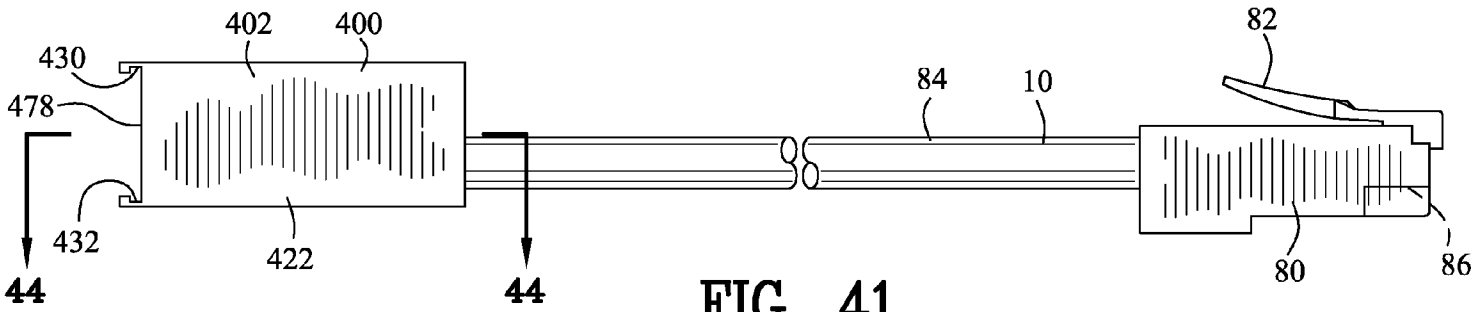
FIG. 41 is a side view of FIG. 40.
Figure 42:
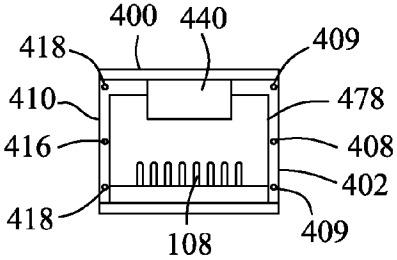
FIG. 42 is a rear view of FIG. 40.
Figure 43:
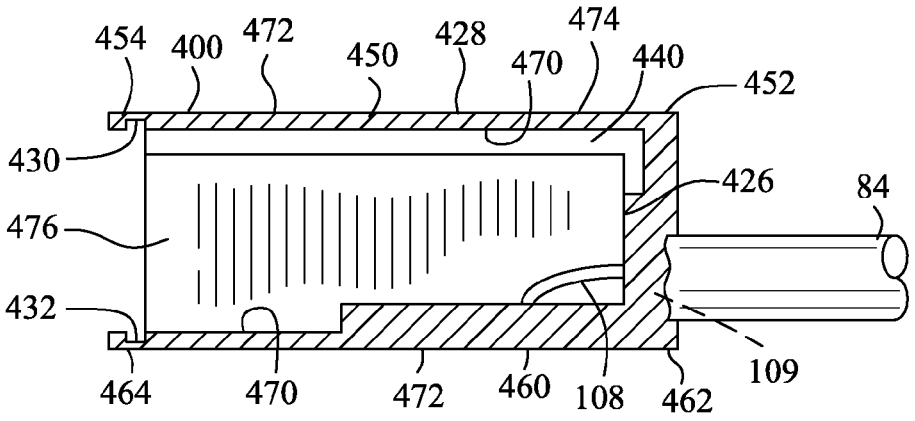
FIG. 43 is a sectional view along line 43-43 in FIG. 40.
Figure 44:
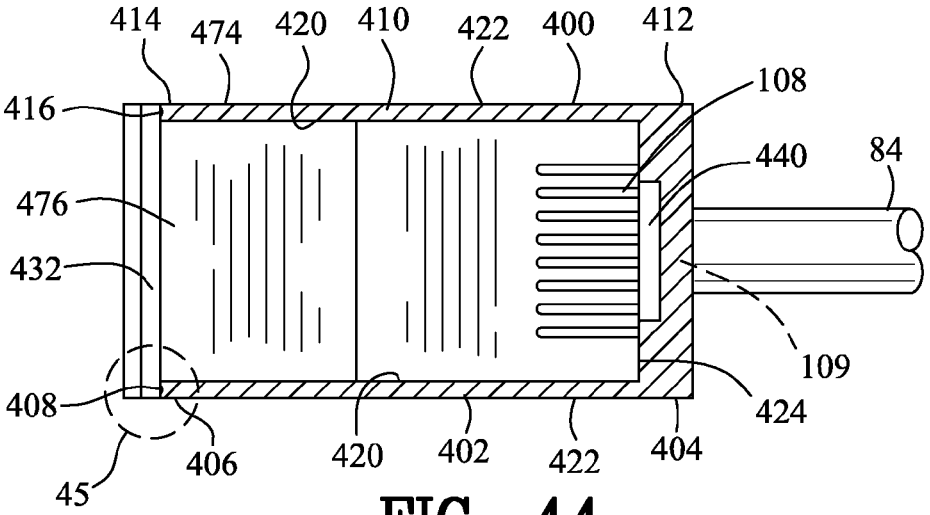
FIG. 44 is a sectional view along line 44-44 in FIG. 41.
Figure 45:
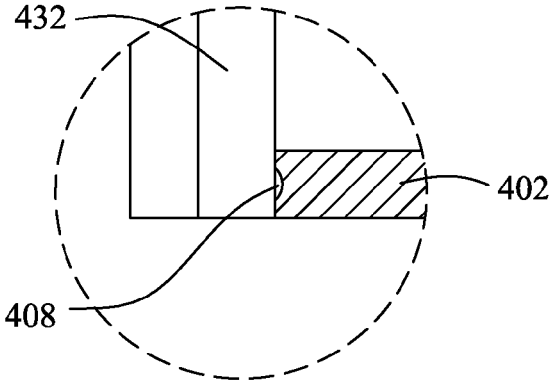
FIG. 45 is an enlarged portion of FIG. 44 illustrating a distal end of a secondary wall having a second nipple.
Figure 51:
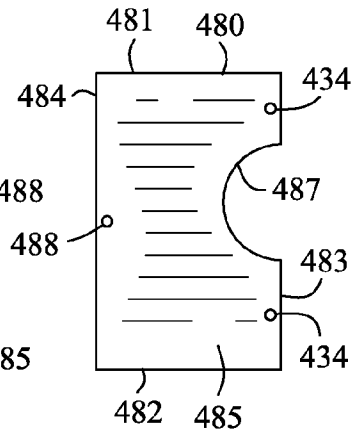
FIG. 51 is a rear view of FIG. 49.
Figure 50:
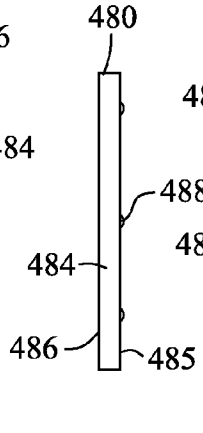
FIG. 50 is a side view of FIG. 49.
Figure 49:
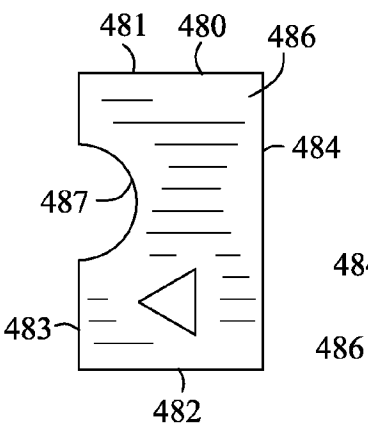
FIG. 49 is a front view of a second closure door.
Figure 46:
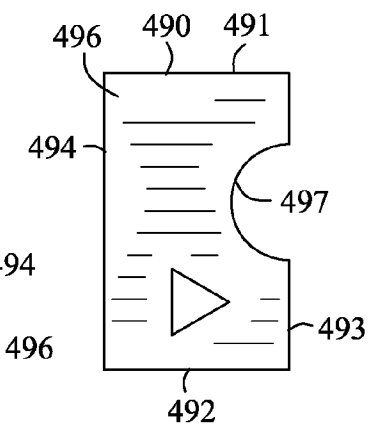
FIG. 46 is a front view of a first closure door.
Figure 47:
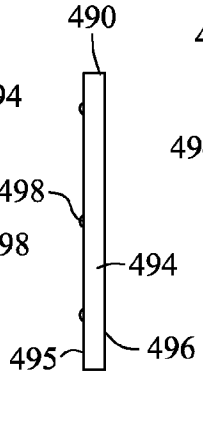
FIG. 47 is a side view of FIG. 46.
Figure 48:
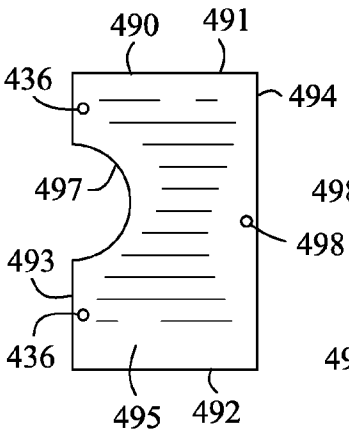
FIG. 48 is a rear view of FIG. 46.
Figure 52:
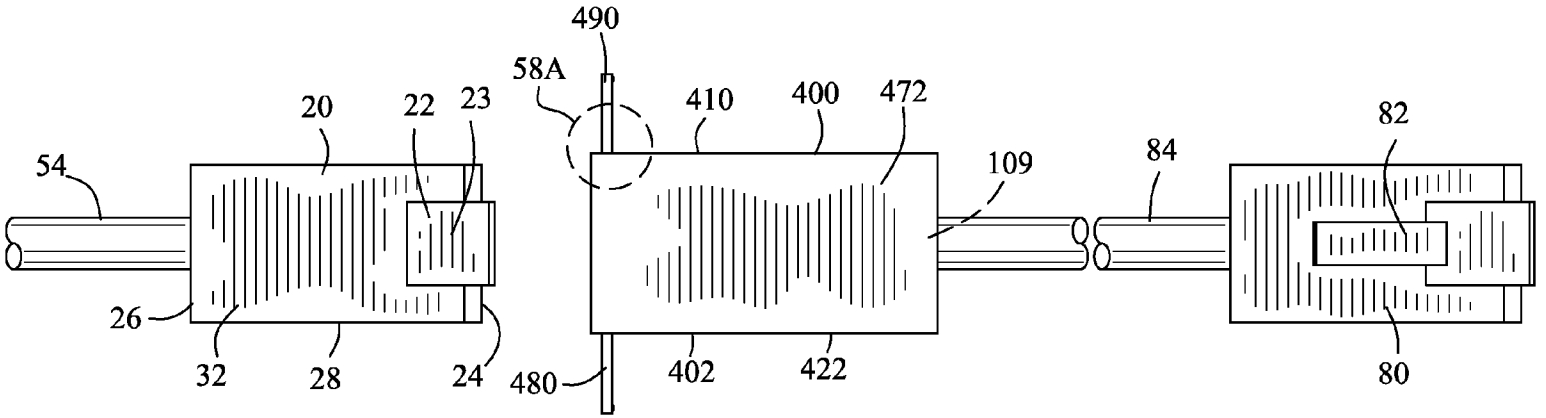
FIG. 52 is a view similar to FIG. 41 illustrating the male plug positioned adjacent to the substitute female clip.
Figure 53:
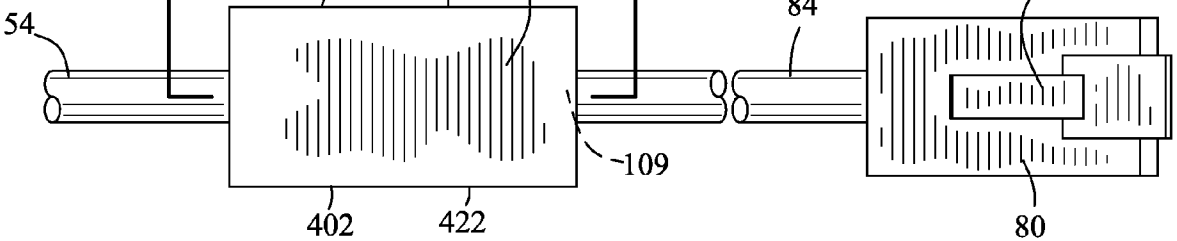
FIG. 53 is a view similar to FIG. 52 illustrating the male plug positioned within substitute female clip.
Figure 54:
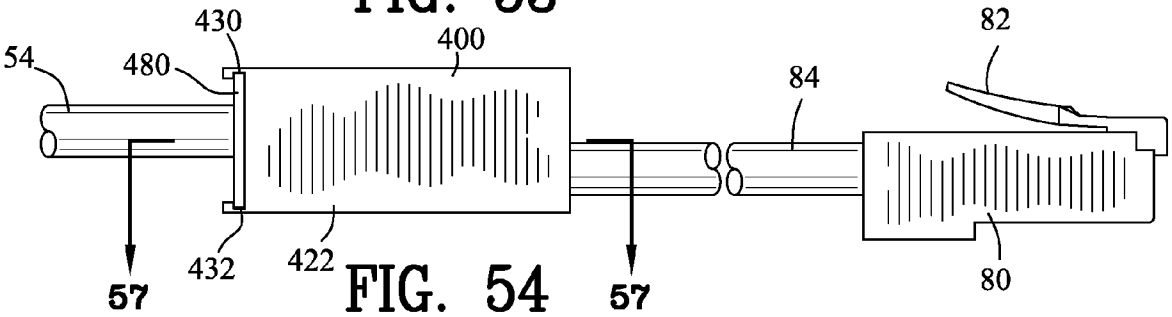
FIG. 54 is a side view of FIG. 53.
Figure 55:
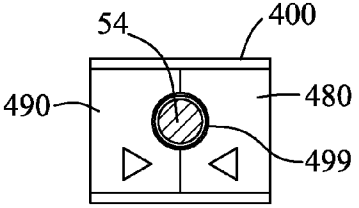
FIG. 55 is a rear view of FIG. 54 illustrating the first closure door and the second closure door abutting for preventing inadvertent removal of the male plug from the substitute female clip.
Figure 56:
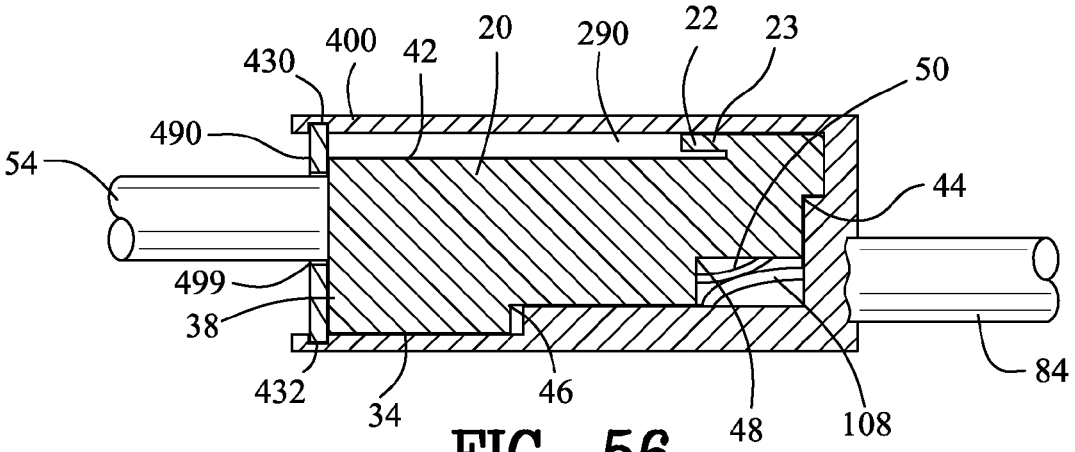
FIG. 56 is a sectional view along line 56-56 in FIG. 53.
Figure 57:
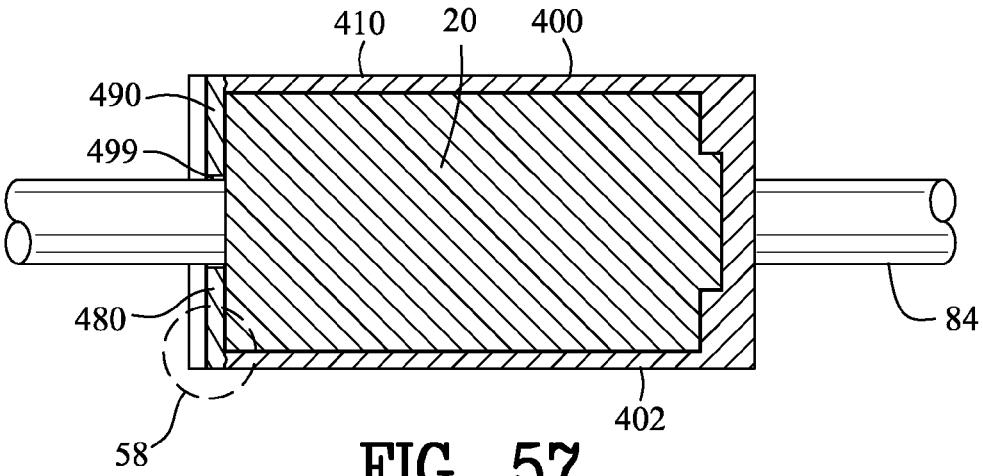
FIG. 57 is a sectional view along line 57-57 in FIG. 54.
Figure 58:
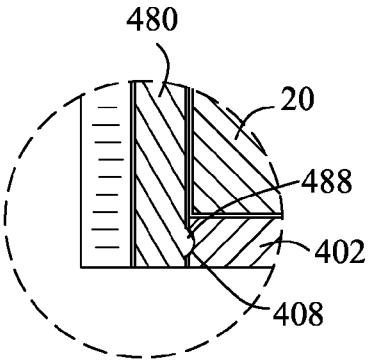
FIG. 58 is an enlarged a portion of FIG. 57 illustrating a second nipple of the second closure door engaging a second nipple receiver for preventing inadvertent displacement of the second closure door.
Figure 58A:
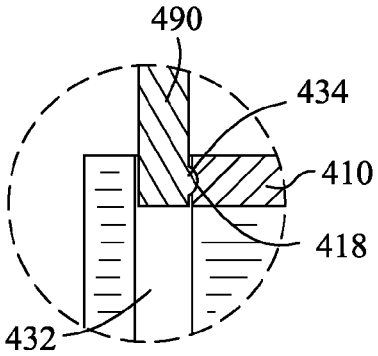
FIG. 58A is an enlarged portion and partial sectional view of FIG. 52 illustrating a first stop notch engaging a second stop nipple receiver for maintaining the second closure door in an open position and permitting the male plug to be removed from the substitute female clip.
Figure 59:
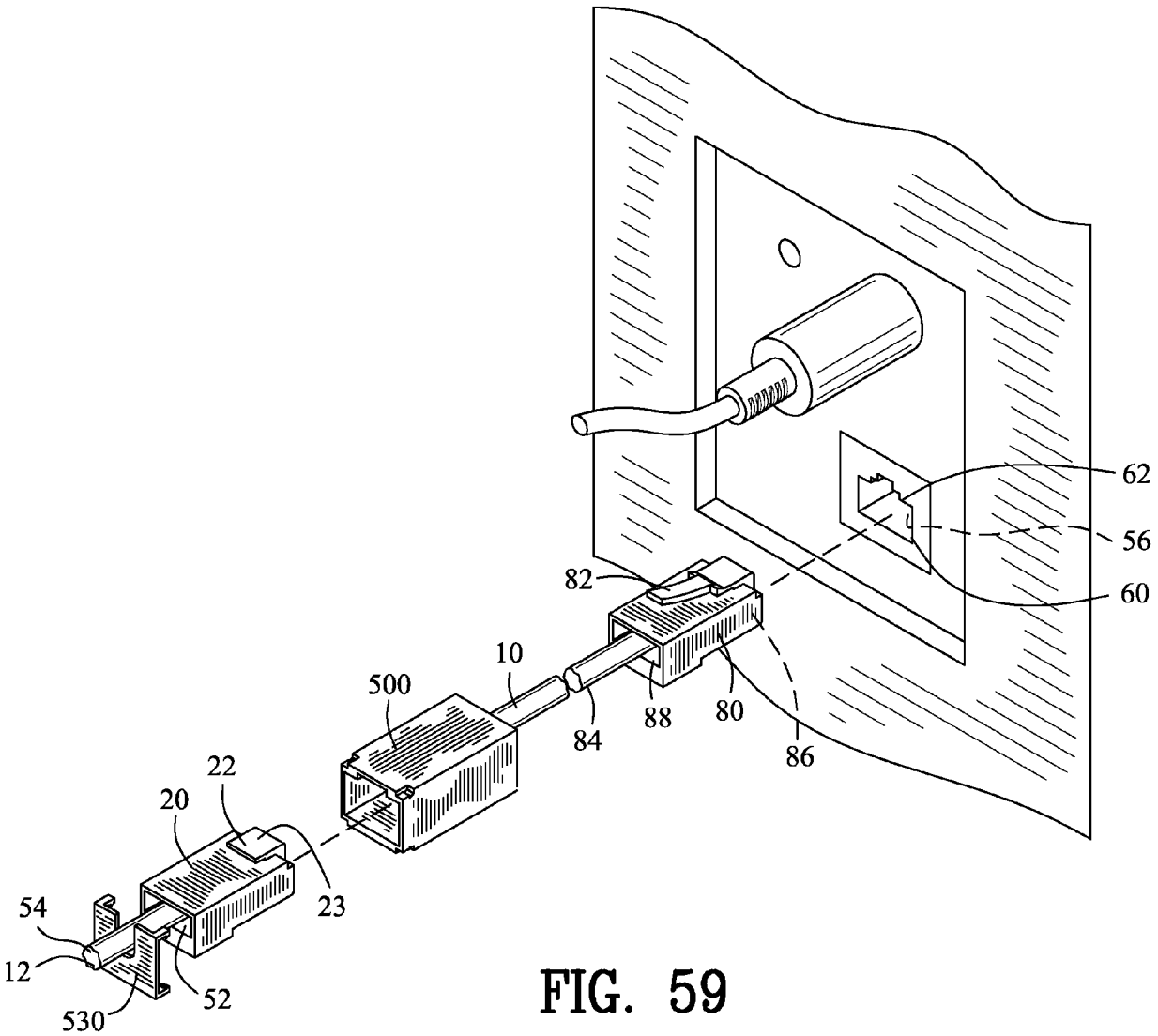
FIG. 59 is a front isometric view of an electrical conduit for conveying an electrical current between a male plug and a female receptacle incorporating a fifth embodiment of the present invention.
Figure 60:
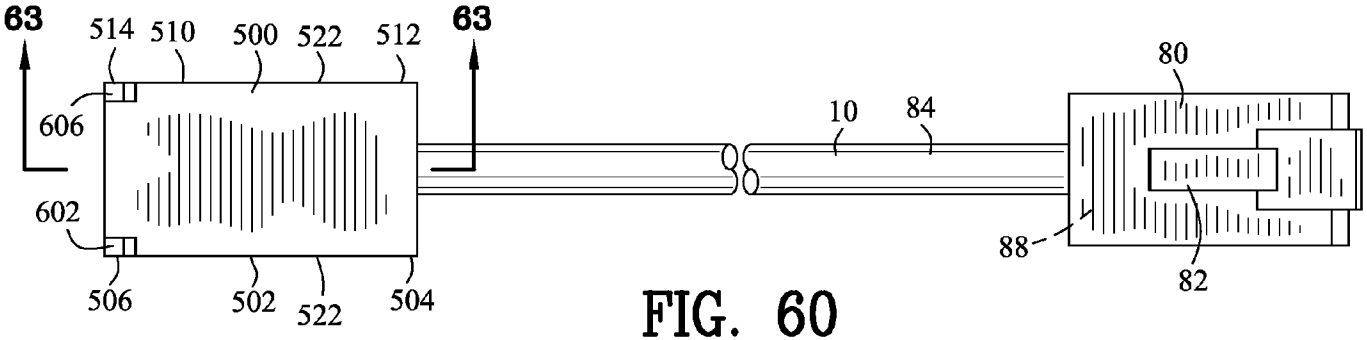
FIG. 60 is a top view of the electrical conduit of FIG. 59.
Figure 61:
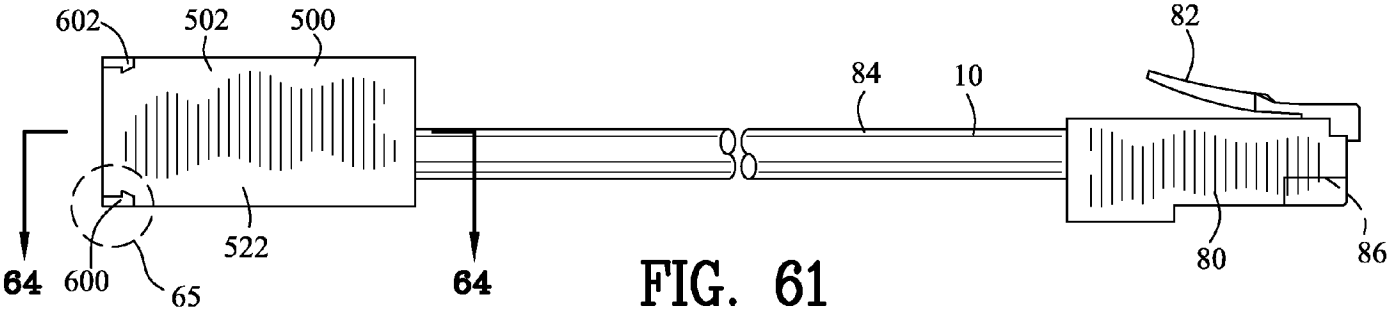
FIG. 61 is a side view of FIG. 60.
Figure 62:
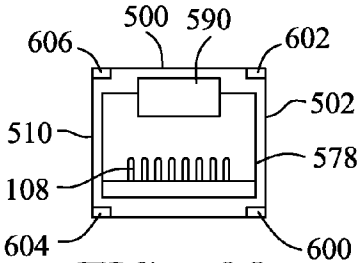
FIG. 62 is a rear view of FIG. 60.
Figure 63:
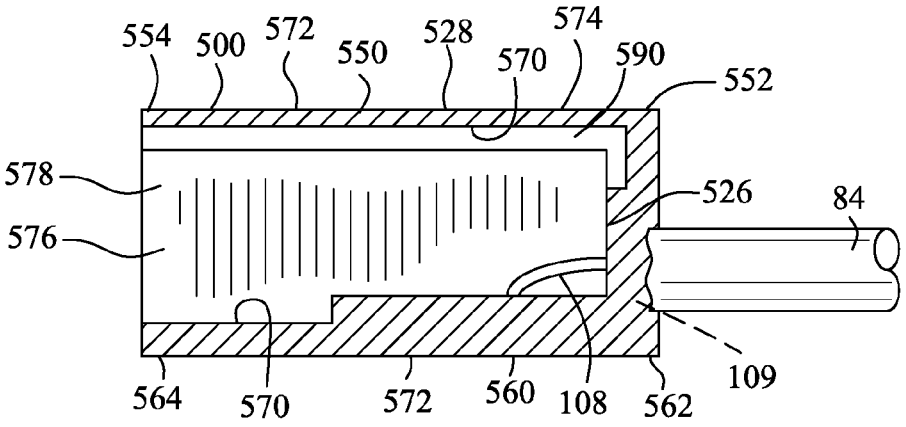
FIG. 63 is a sectional view along line 63-63 in FIG. 60.
Figure 64:
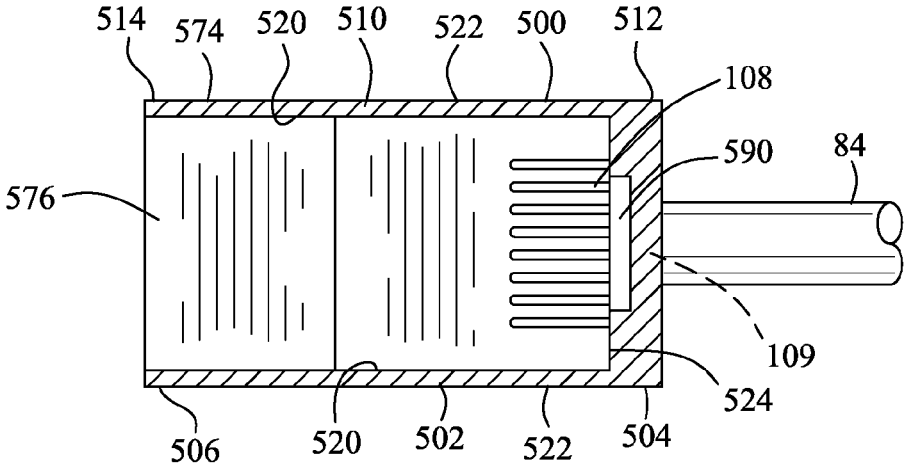
FIG. 64 is a sectional view along line 64-64 in FIG. 61.
Figure 65:
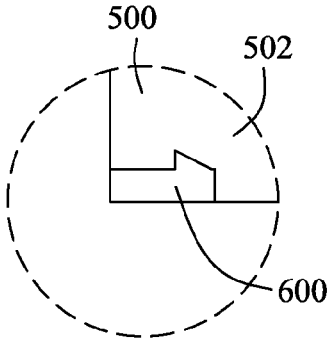
FIG. 65 is an enlarged portion of FIG. 61 illustrating the elongated enclosure having a hook channel.
Figure 69:
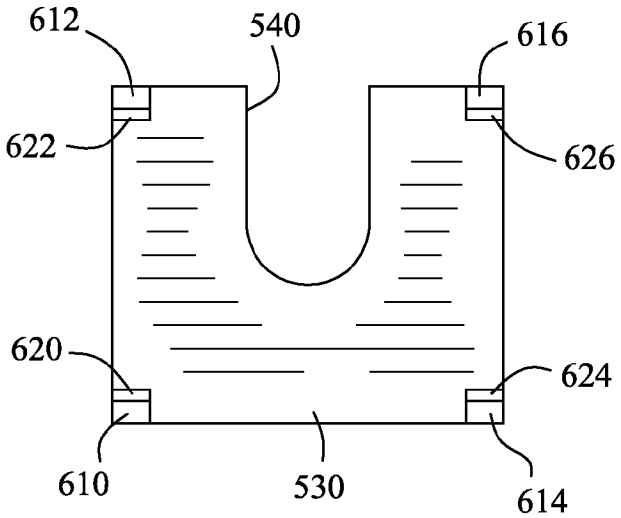
FIG. 69 is a bottom view of FIG. 66.
Figure 68:
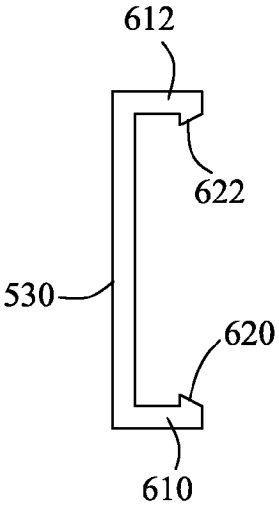
FIG. 68 is a side view of FIG. 66.
Figure 67:
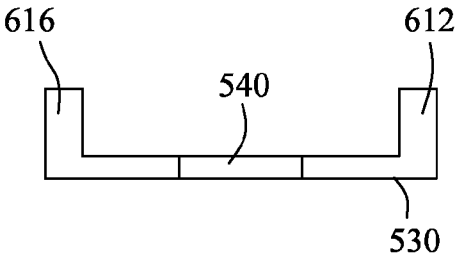
FIG. 67 is a top view of FIG. 66.
Figure 66:
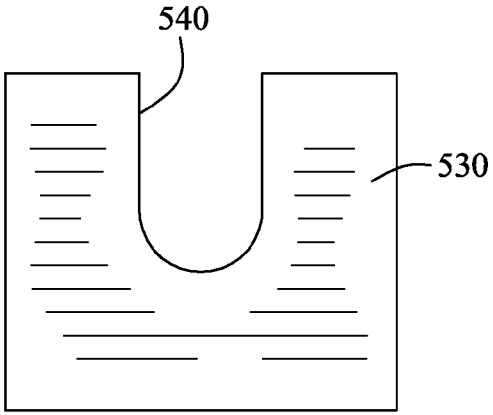
FIG. 66 is a top view of a closure wall.
Figure 70:
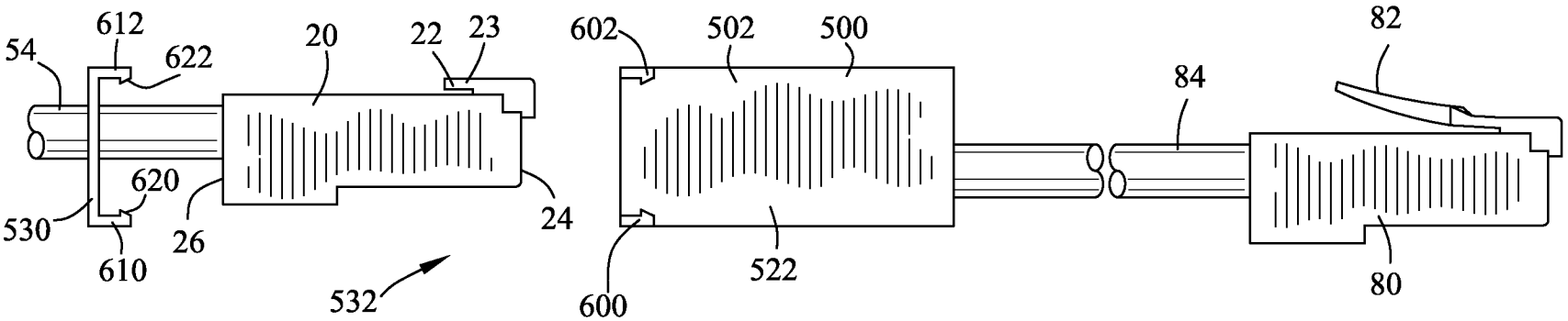
FIG. 70 is a view similar to FIG. 61 illustrating the male plug positioned adjacent to the substitute female clip.
Figure 71:
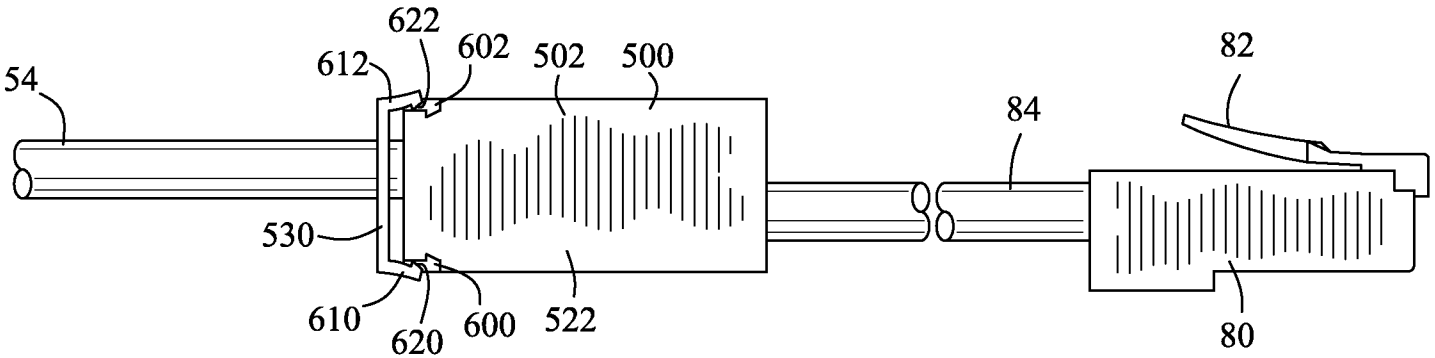
FIG. 71 is a view similar to FIG. 70 illustrating a first closure arm, a second closure arm, a third closure arm and a fourth closure arm of the closure wall deflecting outwardly upon a first arm hook a second arm hook a third arm hook and a fourth arm hook contacting a first hook channel, a second hook channel, a third hook channel and a fourth hook channel of the substitute female clip respectively.

A closure wall 230 pivotably coupled adjacent to the enclosure aperture 278. The closure wall 230 pivots between an open position 232 as shown in FIGS. 12-20 for permitting the male plug 20 to be displaced relative to the elongated enclosure 274 and a closed position 234 as shown in FIGS. 22-24 for preventing inadvertent removal of the male plug 20 from the substitute female clip 200.

The closure wall 230 has a closure wall slot 240 for receiving the flexible electrical conduit 84 upon closure wall 230 positioned into the closed position 234. A first closure arm 242 is coupled to the closure wall 230. A second closure arm 244 is coupled to the closure wall 230. The first closure arm 242 includes a first arm hook 246. The second closure arm 244 includes a second arm hook 248. The first arm hook 246 and the second arm hook 248 define an aligned and converging orientation 280. The elongated enclosure 274 includes a first hook channel 282 and a second hook channel 284. The first arm hook 246 and the second arm hook 248 contact the elongated enclosure 274 and the first closure arm 242 and the second closure arm 244 deflect outwardly upon the closure wall 230 approaching the closed position 234. The first arm hook 246 and the second arm hook 248 engage with the first hook channel 282 and a second hook channel 284 respectively and the first closure arm 242 and the second closure arm 244 deflect inwardly for defining a first closure lock 286 and a second closure lock 288 respectively for maintaining the closure wall 230 in the closed position 234.

The substitute female clip 200 may include a clip channel 290 for receiving the locking clip 22 or partial locking clip 23 of the male plug 20 and preventing rotation of the male plug 20 relative to the substitute female clip 200.

FIGS. 25-38 illustrate a third embodiment of the electrical conduit 10. In the third embodiment the substitute female clip 300 has a cylindrical body 302 defining an exterior cylindrical wall 304, an interior cylindrical wall 306 and a cylindrical chamber 308. The cylindrical body 302 extends between a proximal end 310 and a distal end 312. The distal end 312 of the cylindrical body 302 defines an aperture 314. The cylindrical body 302 defines a cylindrical diameter 316. The cylindrical diameter 316 is greater than the plug width 36 for inserting the male plug 20 through the aperture 314 and positioning the male plug 20 within the cylindrical chamber 308.

The interior cylindrical wall 306 of the cylindrical body 302 may include a primary wall 320, a secondary wall 322, an upper wall 324 and a lower wall 326. The primary wall 320 and the secondary wall 322 define a first wall separation distance 330 there between. The upper wall 324 and the lower wall 326 define a second wall separation distance 332 there between. The first wall separation distance 330 is generally equivalent to the plug width 36. The second wall separation distance 332 is generally equivalent to the plug height 38.

The primary wall 320, the secondary wall 322, the upper wall 324 and the lower wall 326 define a socket enclosure 334 having a socket chamber 336. The socket enclosure 334 has a socket aperture 338 for positioning the male plug 20 within the socket chamber 336 and preventing rotation of the male plug 20 relative to the substitute female clip 300.

The exterior cylindrical wall 304 may have a cylindrical threading 340 adjacent to the distal end 312 of the cylindrical body 302. A cylindrical cap 342 has a cap closure wall 344 and a cap cylindrical portion 346. The cap cylindrical portion 346 has a cap threading 348. The cap closure wall 344 has a cap aperture 350 for positioning the male plug 20 through the cylindrical cap 342. A cylindrical spacer 352 has a spacer diameter 354 and a spacer height 356. The cylindrical spacer 352 has a spacer slot 358 for receiving the flexible electrical conduit 84. The spacer diameter 354 is less than the cylindrical diameter 316 for positioning the cylindrical spacer 352 into the aperture 314. The cap threading 348 of the cylindrical cap 342 engages the cylindrical threading 340 of the cylindrical body 302 for compressing the cylindrical spacer 352 against the male plug 20 and for preventing inadvertent removal of the male plug 20 from the substitute female clip 300. The substitute female clip 300 may further includes a clip channel 360 for receiving the locking clip 22 or partial locking clip 23 of the male plug 20 and preventing rotation of the male plug 20 relative to the substitute female clip 300.

FIGS. 39-57 illustrate a fourth embodiment of the electrical conduit 10. In the fourth embodiment the substitute female clip 400 has a primary wall 402, a secondary wall 410, an upper wall 450 and a lower wall 460 each having an interior surface 420 and an exterior surface 422. The primary wall 402 extends between a proximal end 404 and a distal end 406. The secondary wall 410 extends between a proximal end 412 and a distal end 414. The upper wall 450 extends between a proximal end 452 and a distal end 454. The lower wall 460 extends between a proximal end 462 and a distal end 464. The primary wall 402 and the secondary wall 410 define a first wall separation distance 424 there between. The upper wall 450 and the lower wall 460 define a second wall separation distance 426 there between. The first wall separation distance 424 is generally equivalent to the plug width 36. The second wall separation distance 426 is generally equivalent to the plug height 38. The primary wall 402, the secondary wall 410, the upper wall 450 and the lower wall 460 define an elongated enclosure 474 having an enclosure chamber 476. The elongated enclosure 474 has an enclosure aperture 478 adjacent to the distal ends 406, 414, 454 and 464 of the primary wall 402, the secondary wall 410, the upper wall 450 and the lower wall 460 for positioning the male plug 20 within the enclosure chamber 476. The elongated enclosure 474 defines an enclosure length 428. The enclosure length 428 is greater than the plug length 42 for encapsulating the male plug 20 within the elongated enclosure 474.

The distal end 454 of the upper wall 450 has an upper track 430 in the interior surface 420 of the upper wall 450. The distal end 464 of the lower wall 460 has a lower track 432 in the interior surface 420 of the lower wall 460. A first closure door 480 has an upper edge 481, a lower edge 482, an interior edge 483, an outer edge 484, an interior surface 485 and an exterior surface 486. The interior edge 483 of the first closure door 480 has a first notch 487. A second closure door 490 has an upper edge 491, a lower edge 492, an interior edge 493, an outer edge 494, an interior surface 495 and an exterior surface 496. The interior edge 493 of the second closure door 490 has a second notch 497.

The upper edge 481 and the lower edge 482 of the first closure door 480 engage within the upper track 430 and the lower track 432 respectively. The upper edge 491 and the lower edge 492 of the second closure door 490 engage within the upper track 430 and the lower track 432 respectively. The interior edge 483 of the first closure door 480 and the interior edge 493 of the second closure door 490 abut for preventing inadvertent removal of the male plug 20 from the substitute female clip 400 and for defining a door notch 499 from the first notch 487 and the second notch 497 for receiving the flexible electrical conduit 84.

The distal end 406 of the primary wall 402 has a first nipple receiver 408. The distal end 414 of the secondary wall 410 has a second nipple receiver 416. The interior surface 485 of the first closure door 480 has a first nipple 488. The interior surface 495 of the second closure door 490 has a second nipple 498. The first nipple 408 and the second nipple 416 engage the first nipple receiver 488 and the second nipple receiver 498 respectively upon the interior edge 483 of the first closure door 480 and the interior edge 493 of the second closure door 490 abutting for preventing inadvertent displacement of the first closure door 480 and the second closure door 490.

The distal end 406 of the primary wall 402 may further include a first stop nipple receiver 409. The distal end 414 of the secondary wall 410 may further include a second stop nipple receiver 418. The interior surface 485 of the first closure door 480 has a first stop notch 434. The interior surface 495 of the second closure door 490 has a second stop notch 436. The first stop notch 434 and the second stop notch 436 engage the first stop nipple receiver 409 and the second stop nipple receiver 418 respectively upon the interior edge 483 of the first closure door 480 and the interior edge 493 of the second closure door 490 positioned adjacent to said primary wall 402 and the secondary wall 410 respectively for maintaining the first closure door 480 and the second closure door 490 in an open position and permitting the male plug 20 to be removed from the substitute female clip 400.

The substitute female clip 400 may further include a clip channel 440 for receiving the locking clip 22 or partial locking clip 23 of the male plug 20 and preventing rotation of the male plug 20 relative to the substitute female clip 400.

FIGS. 58-72 illustrate a fifth embodiment of the electrical conduit 10. In the fifth embodiment the substitute female clip 500 has a has a primary wall 502, a secondary wall 510, an upper wall 550 and a lower wall 560 each having an interior surface 520 and an exterior surface 522. The primary wall 502 extends between a proximal end 504 and a distal end 506. The secondary wall 510 extends between a proximal end 512 and a distal end 514. The upper wall 550 extends between a proximal end 552 and a distal end 554. The lower wall 560 extends between a proximal end 562 and a distal end 564. The primary wall 502 and the secondary wall 510 define a first wall separation distance 524 there between. The upper wall 550 and the lower wall 560 define a second wall separation distance 526 there between. The first wall separation distance 524 is generally equivalent to the plug width 36. The second wall separation distance 526 is generally equivalent to the plug height 38. The primary wall 502, the secondary wall 510, the upper wall 550 and the lower wall 560 define an elongated enclosure 574 having an enclosure chamber 576. The elongated enclosure 574 has an enclosure aperture 578 adjacent to the distal ends 506, 514, 554 and 564 of the primary wall 502, the secondary wall 510, the upper wall 550 and the lower wall 560 for positioning the male plug 20 within the enclosure chamber 576. The elongated enclosure 574 defines an enclosure length 528. The enclosure length 528 is greater than the plug length 42 for encapsulating the male plug 20 within the elongated enclosure 574.

The elongated enclosure 574 includes a first hook channel 600, a second hook channel 602, a third hook channel 604 and a fourth hook channel 606. A closure wall 530 has a first closure arm 610, a second closure arm 612, a third closure arm 614 and a fourth closure arm 616. The first closure arm 610, the second closure arm 612, the third closure arm 614 and the fourth closure arm 616 include a first arm hook 620, a second arm hook 622, a third arm hook 624 and a fourth arm hook 626 respectively. The first arm hook 620, the second arm hook 622, the third arm hook 624 and the fourth arm hook 626 contact the elongated enclosure 574 and the first closure arm 610, the second closure arm 612, the third closure arm 614 and the fourth closure arm 616 deflect outwardly upon the closure wall 530 positioned over the enclosure aperture 578.

The first arm hook 620, the second arm hook 622, the third arm hook 624 and the fourth arm hook 626 engage with the first hook channel 600, the second hook channel 602, the third hook channel 604 and the fourth hook channel 606, respectively. The first closure arm 610, the second closure arm 612, the third closure arm 614 and the fourth closure arm 616 deflect inwardly for defining a first closure lock 630, a second closure lock 632, a third closure lock 634 and a fourth closure lock 646 respectively for maintaining the closure wall 530 against the enclosure aperture 578. The closure wall 530 abutting the enclosure aperture 578 define a closed position 534 for preventing inadvertent removal of the male plug 20 from the substitute female clip 500. The closure wall 530 has a closure wall slot 540 for receiving the flexible electrical conduit 84 upon closure wall 530 positioned into the closed position 534.

The substitute female clip 500 may include a clip channel 590 for receiving the locking clip 22 or partial locking clip 23 of the male plug 20 and preventing rotation of the male plug 20 relative to the substitute female clip 500.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An electrical conduit for conveying an electrical current between a male plug and a female receptacle, a locking clip pivotably mounted on the male plug, the male plug having a front edge, a rear edge, a first side surface, a second side surface, a top surface and a bottom surface for defining a plug width, a plug height and a plug length, the female receptacle having a locking clip receiver for engaging the locking clip during engagement between the male plug and the female receptacle for preventing the inadvertent removal of the male plug from the female receptacle, the electrical conduit comprising:

a substitute male plug for engaging with the female receptacle;

a substitute locking clip pivotably mounted to said substitute male plug engaging with the locking clip receiver for preventing inadvertent removal of said substitute male plug from the female receptacle;

a substitute female clip for engaging with the male plug;

said substitute female clip having a primary wall and a secondary wall each having an interior surface and an exterior surface;

said primary wall extending between a proximal end and a distal end;

said secondary wall extending between a proximal end and a distal end;

said primary wall and said secondary wall defining a wall separation distance there between;

said wall separation distance being generally equivalent to the plug width;

a first plug hook coupled to said interior surface of said primary wall;

a second plug hook coupled to said interior surface of said secondary wall;

said primary wall and said secondary wall deflecting outwardly upon said first plug hook and said second plug hook contacting the first side surface and the second side surface of the male plug respectively and said primary wall and said secondary wall deflecting inwardly upon said first plug hook and said second plug hook being displaced beyond the rear edge of the male plug;

said first plug hook engagement with the rear edge of the male plug defining a first retaining lock for preventing inadvertent removal of the male plug from said substitute female clip;

said second plug hook engagement with the rear edge of the male plug defining a second retaining lock for preventing inadvertent removal of the male plug from said substitute female clip; and a flexible electrical conduit coupling said substitute male plug and said substitute female clip for transmitting the electrical current between the male plug and the female receptacle.

2. The electrical conduit for conveying an electrical current as set forth in claim 1, wherein said substitute female clip includes an upper wall and a lower wall each having an interior surface and an exterior surface;

said upper wall extending between a proximal end and a distal end;

said lower wall extending between a proximal end and a distal end;

said proximal end of said upper wall abutting with said proximal end of said primary wall and said proximal end of said secondary wall;

said proximal end of said lower wall abutting with said proximal end of said primary wall and said proximal end of said secondary wall;

said distal end of said upper wall positioned between said proximal end of said primary wall and said distal end of said primary wall;

said distal end of said lower wall positioned between said proximal end of said secondary wall and said distal end of said secondary wall;

said primary wall, said secondary wall, said upper wall and said lower wall defining a socket; and said socket defining a socket chamber for receiving the male plug and preventing rotation of the male plug relative to said substitute female clip.

3. The electrical conduit for conveying an electrical current as set forth in claim 1, wherein said substitute female clip includes an upper wall and a lower wall each having an interior surface and an exterior surface; and said interior surface of said upper wall including a clip channel for receiving the locking clip of the male plug and preventing rotation of the male plug relative to said substitute female clip.

4. The electrical conduit for conveying an electrical current as set forth in claim 1, wherein said substitute female clip includes an upper wall and a lower wall each having an interior surface and an exterior surface;

said upper wall extending between a proximal end and a distal end;

said lower wall extending between a proximal end and a distal end;

said proximal end of said upper wall abutting with said proximal end of said primary wall and said proximal end of said secondary wall;

said proximal end of said lower wall abutting with said proximal end of said primary wall and said proximal end of said secondary wall;

said distal end of said upper wall positioned between said proximal end of said primary wall and said distal end of said primary wall;

said distal end of said lower wall positioned between said proximal end of said secondary wall and said distal end of said secondary wall;

said primary wall, said secondary wall, said upper wall and said lower wall defining a socket;

said socket defining a socket chamber for receiving the male plug and preventing rotation of the male plug relative to said substitute female clip; and said interior surface of said upper wall including a clip channel for receiving the locking clip of the male plug and preventing rotation of the male plug relative to said substitute female clip.

5. An electrical conduit for conveying an electrical current between a male plug and a female receptacle, a locking clip pivotably mounted on the male plug, the male plug having a front edge, a rear edge, a first side surface, a second side surface, a top surface and a bottom surface for defining a plug width, a plug height and a plug length, the female receptacle having a locking clip receiver for engaging the locking clip during engagement between the male plug and the female receptacle for preventing the inadvertent removal of the male plug from the female receptacle, the electrical conduit comprising:

a substitute male plug for engaging with the female receptacle;

a substitute locking clip pivotably mounted to said substitute male plug engaging with the locking clip receiver for preventing inadvertent removal of said substitute male plug from the female receptacle;

a substitute female clip for engaging with the male plug;

said substitute female clip having a primary wall, a secondary wall, an upper wall and a lower wall each having an interior surface and an exterior surface;

said primary wall extending between a proximal end and a distal end;

said secondary wall extending between a proximal end and a distal end;

said upper wall extending between a proximal end and a distal end;

said lower wall extending between a proximal end and a distal end;

said primary wall and said secondary wall defining a first wall separation distance there between;

said upper wall and said lower wall defining a second wall separation distance there between;

said first wall separation distance being generally equivalent to the plug width;

said second wall separation distance being generally equivalent to the plug height;

said primary wall, said secondary wall, said upper wall and said lower wall defining an elongated enclosure having an enclosure chamber;

said elongated enclosure having an enclosure aperture adjacent to said distal end of said primary wall, said secondary wall, said upper wall and said lower wall for positioning the male plug within said enclosure chamber;

said elongated enclosure defining an enclosure length;

said enclosure length being greater than the plug length for encapsulating the male plug within the elongated enclosure;

said elongated enclosure includes a closure wall pivotably coupled adjacent to said enclosure aperture;

said closure wall pivoting between an open position for permitting the male plug to be displaced relative to said elongated enclosure and a closed position for preventing inadvertent removal of the male plug from said substitute female clip; and said closure wall having a closure wall slot for receiving the flexible electrical conduit upon closure wall positioned into said closed position.

6. The electrical conduit for conveying an electrical current as set forth in claim 5, further including a first closure arm coupled to said closure wall;

a second closure arm coupled to said closure wall;

said first closure arm including a first arm hook;

said second closure arm including a second arm hook;

said first arm hook and said second arm hook defining an aligned and converging orientation;

said elongated enclosure including a first hook channel and a second hook channel;

said first arm hook and said second arm hook contacting said elongated enclosure and said first closure arm and said second closure arm deflecting outwardly upon said closure wall approaching said closed position; and said first arm hook and said second arm hook engaging with said first hook channel and a second hook channel respectively and said first closure arm and said second closure arm deflecting inwardly for defining a first closure lock and a second closure lock respectively for maintaining said closure wall in said closed position.

7. The electrical conduit for conveying an electrical current as set forth in claim 5, wherein said substitute female clip includes a clip channel for receiving the locking clip of the male plug and preventing rotation of the male plug relative to said substitute female clip.

8. An electrical conduit for conveying an electrical current between a male plug and a female receptacle, a locking clip pivotably mounted on the male plug, the male plug having a front edge, a rear edge, a first side surface, a second side surface, a top surface and a bottom surface for defining a plug width, a plug height and a plug length, the female receptacle having a locking clip receiver for engaging the locking clip during engagement between the male plug and the female receptacle for preventing the inadvertent removal of the male plug from the female receptacle, the electrical conduit comprising:

a substitute male plug for engaging with the female receptacle;

a substitute locking clip pivotably mounted to said substitute male plug engaging with the locking clip receiver for preventing inadvertent removal of said substitute male plug from the female receptacle;

a substitute female clip for engaging with the male plug;

said substitute female clip having a cylindrical body defining an exterior cylindrical wall, an interior cylindrical wall and a cylindrical chamber;

said cylindrical body extending between a proximal end and a distal end;

said distal end of said cylindrical body defining an aperture;

said cylindrical body defining a cylindrical diameter;

said cylindrical diameter being greater than the plug width for inserting the male plug through said aperture and positioning the male plug within said cylindrical chamber;

said exterior cylindrical wall having a cylindrical threading adjacent to said distal end of said cylindrical body;

a cylindrical cap having a cap closure wall and a cap cylindrical portion;

said cap cylindrical portion having a cap threading;

said cap closure wall having a cap aperture for positioning the male plug through said cylindrical cap;

a cylindrical spacer having a spacer diameter and a spacer height;

said cylindrical spacer having a spacer slot for receiving the flexible electrical conduit;

said spacer diameter being less than said cylindrical diameter for positioning said cylindrical spacer into said aperture; and said cap threading of said cylindrical cap engaging said cylindrical threading of said cylindrical body for compressing said cylindrical spacer against the male plug and for preventing inadvertent removal of the male plug from said substitute female clip.

9. The electrical conduit for conveying an electrical current as set forth in claim 8, wherein said interior cylindrical wall includes a primary wall, a secondary wall, an upper wall and a lower wall;

said primary wall and said secondary wall defining a first wall separation distance there between;

said upper wall and said lower wall defining a second wall separation distance there between;

said first wall separation distance being generally equivalent to the plug width;

said second wall separation distance being generally equivalent to the plug height;

said primary wall, said secondary wall, said upper wall and said lower wall defining an socket enclosure having an socket chamber; and said socket enclosure having an socket aperture for positioning the male plug within said socket chamber and preventing rotation of the male plug relative to said substitute female clip.

10. The electrical conduit for conveying an electrical current as set forth in claim 8, wherein said substitute female clip includes a clip channel for receiving the locking clip of the male plug and preventing rotation of the male plug relative to said substitute female clip.

11. An electrical conduit for conveying an electrical current between a male plug and a female receptacle, a locking clip pivotably mounted on the male plug, the male plug having a front edge, a rear edge, a first side surface, a second side surface, a top surface and a bottom surface for defining a plug width, a plug height and a plug length, the female receptacle having a locking clip receiver for engaging the locking clip during engagement between the male plug and the female receptacle for preventing the inadvertent removal of the male plug from the female receptacle, the electrical conduit comprising:

a substitute male plug for engaging with the female receptacle;

a substitute locking clip pivotably mounted to said substitute male plug engaging with the locking clip receiver for preventing inadvertent removal of said substitute male plug from the female receptacle;

a substitute female clip for engaging with the male plug;

said substitute female clip having a primary wall, a secondary wall, an upper wall and a lower wall each having an interior surface and an exterior surface;

said primary wall extending between a proximal end and a distal end;

said secondary wall extending between a proximal end and a distal end;

said upper wall extending between a proximal end and a distal end;

said lower wall extending between a proximal end and a distal end;

said primary wall and said secondary wall defining a first wall separation distance there between;

said upper wall and said lower wall defining a second wall separation distance there between;

said first wall separation distance being generally equivalent to the plug width;

said second wall separation distance being generally equivalent to the plug height;

said primary wall, said secondary wall, said upper wall and said lower wall defining an elongated enclosure having an enclosure chamber;

said elongated enclosure having an enclosure aperture adjacent to said distal end of said primary wall, said secondary wall, said upper wall and said lower wall for positioning the male plug within said enclosure chamber;

said elongated enclosure defining an enclosure length;

said enclosure length being greater than the plug length for encapsulating the male plug within the elongated enclosure;

said distal end of said upper wall having an upper track in said interior surface of said upper wall;

said distal end of said lower wall having a lower track in said interior surface of said lower wall;

a first closure door having an upper edge, a lower edge, an interior edge, an outer edge, an interior surface and an exterior surface;

said interior edge of said first closure door having a first notch;

a second closure door having an upper edge, a lower edge, an interior edge, an outer edge an interior surface and an exterior surface;

said interior edge of said second closure door having a second notch;

said upper edge and said lower edge of said first closure door engaging within said upper track and said lower track respectively;

said upper edge and said lower edge of said second closure door engaging within said upper track and said lower track respectively; and said interior edge of said first closure door and said interior edge of said second closure door abutting for preventing inadvertent removal of the male plug from said substitute female clip and for defining a door notch from said first notch and said second notch for receiving the flexible electrical conduit.

12. The electrical conduit for conveying an electrical current as set forth in claim 11, wherein said distal end of said primary wall having a first nipple receiver;

said distal end of said secondary wall having a second nipple receiver;

said interior surface of said first closure door having a first nipple;

said interior surface of said second closure door having a second nipple; and said first nipple and said second nipple engaging said first nipple receiver and said second nipple receiver respectively upon said interior edge of said first closure door and said interior edge of said second closure door abutting for preventing inadvertent displacement of said first closure door and the second closure door.

13. The electrical conduit for conveying an electrical current as set forth in claim 11, wherein said substitute female clip includes a clip channel for receiving the locking clip of the male plug and preventing rotation of the male plug relative to said substitute female clip.

14. An electrical conduit for conveying an electrical current between a male plug and a female receptacle, a locking clip pivotably mounted on the male plug, the male plug having a front edge, a rear edge, a first side surface, a second side surface, a top surface and a bottom surface for defining a plug width, a plug height and a plug length, the female receptacle having a locking clip receiver for engaging the locking clip during engagement between the male plug and the female receptacle for preventing the inadvertent removal of the male plug from the female receptacle, the electrical conduit comprising:

a substitute male plug for engaging with the female receptacle;

a substitute locking clip pivotably mounted to said substitute male plug engaging with the locking clip receiver for preventing inadvertent removal of said substitute male plug from the female receptacle;

a substitute female clip for engaging with the male plug;

said substitute female clip having a primary wall, a secondary wall, an upper wall and a lower wall each having an interior surface and an exterior surface;

said primary wall extending between a proximal end and a distal end;

said secondary wall extending between a proximal end and a distal end;

said upper wall extending between a proximal end and a distal end;

said lower wall extending between a proximal end and a distal end;

said primary wall and said secondary wall defining a first wall separation distance there between;

said upper wall and said lower wall defining a second wall separation distance there between;

said first wall separation distance being generally equivalent to the plug width;

said second wall separation distance being generally equivalent to the plug height;

said primary wall, said secondary wall, said upper wall and said lower wall defining an elongated enclosure having an enclosure chamber;

said elongated enclosure having an enclosure aperture adjacent to said distal end of said primary wall, said secondary wall, said upper wall and said lower wall for positioning the male plug within said enclosure chamber;

said elongated enclosure defining an enclosure length;

said enclosure length being greater than the plug length for encapsulating the male plug within the elongated enclosure;

said elongated enclosure including a first hook channel, a second hook channel, a third hook channel and a fourth hook channel;

a closure wall having a first closure arm, a second closure arm, a third closure arm and a fourth closure arm;

said first closure arm, said second closure arm, said third closure arm and said fourth closure arm including a first arm hook, a second arm hook, a third arm hook and a fourth arm hook respectively;

said first arm hook, said second arm hook, said third arm hook and said fourth arm hook contacting said elongated enclosure and said first closure arm, said second closure arm, said third closure arm and said fourth closure arm deflecting outwardly upon said closure wall positioned over said enclosure aperture;

said first arm hook, said second arm hook, said third arm hook and said fourth arm hook engaging with said first hook channel, said second hook channel, said third hook channel and said fourth hook channel, respectively and said first closure arm, said second closure arm, said third closure arm and said fourth closure arm deflecting inwardly for defining a first closure lock, a second closure lock, a third closure lock and a fourth closure lock respectively for maintaining said closure wall against said enclosure aperture;

said closure wall abutting said enclosure aperture defining a closed position for preventing inadvertent removal of the male plug from said substitute female clip; and said closure wall having a closure wall slot for receiving the flexible electrical conduit upon closure wall positioned into said closed position.

15. The electrical conduit for conveying an electrical current as set forth in claim 14, wherein said substitute female clip includes a clip channel for receiving the locking clip of the male plug and preventing rotation of the male plug relative to said substitute female clip.

* * * * *